US007893904B2

(12) United States Patent
Shih et al.

(10) Patent No.: US 7,893,904 B2
(45) Date of Patent: Feb. 22, 2011

(54) DISPLAYING METHOD AND IMAGE DISPLAY DEVICE

(75) Inventors: Ming-Chia Shih, Tainan Science Based Industrial Park (TW); Ying-Hao Hsu, Tainan Science Based Industrial Park (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 1364 days.

(21) Appl. No.: 11/392,685

(22) Filed: Mar. 30, 2006

(65) Prior Publication Data

US 2006/0221030 A1 Oct. 5, 2006

(30) Foreign Application Priority Data

Mar. 30, 2005 (TW) ..... 94110114 A

(51) Int. Cl.
*G09G 3/36* (2006.01)

(52) U.S. Cl. ..... 345/88; 345/690; 345/694; 382/263; 382/264; 382/167

(58) Field of Classification Search ..... 345/88, 345/592–598, 690, 694; 382/263–264, 167
See application file for complete search history.

(56) References Cited

U.S. PATENT DOCUMENTS

| | | | | |
|---|---|---|---|---|
| 6,041,145 | A * | 3/2000 | Hayashi et al. | 382/268 |
| 6,215,561 | B1 * | 4/2001 | Kakutani | 358/1.9 |
| 6,724,941 | B1 * | 4/2004 | Aoyama | 382/254 |
| 6,801,220 | B2 * | 10/2004 | Greier et al. | 345/694 |
| 7,023,576 | B1 * | 4/2006 | Jonsson et al. | 358/1.9 |
| 7,200,279 | B1 * | 4/2007 | Lin | 382/274 |
| 2003/0231802 | A1 * | 12/2003 | Sekino et al. | 382/274 |

* cited by examiner

*Primary Examiner*—Alexander Eisen
*Assistant Examiner*—Viet Pham
(74) *Attorney, Agent, or Firm*—Lowe Hauptman Ham & Berner LLP

(57) ABSTRACT

In a displaying method for use in an image display, an original gray scale is divided into a higher gray scale and a lower gray scale. Further, the color subpixels are divided into two groups corresponding to the higher and lower gray scales, respectively. The gray scale to be expressed by each subpixel is calibrated by weighing the original higher or lower gray scale for the pixel and the adjacent pixels and summing up the results. The color shift problem due to different visual angles can therefore be solved.

2 Claims, 18 Drawing Sheets

| | | |
|---|---|---|
| $A_H$ | $B_H$ | $C_H$ |
| $D_H$ | $E_H$ | $F_H$ |
| $G_H$ | $H_H$ | $I_H$ |

| | | | | | |
|---|---|---|---|---|---|
| $R_{(2,2)}$ 351 | $G'_{L(2,2)}$ $=0.5G_{L(2,2)}$ $+0.125G_{L(1,2)}$ $+0.125G_{L(3,2)}$ $+0.125G_{L(2,1)}$ $+0.125G_{L(2,3)}$ 352 | $R_{(2,2)}$ 353 | $B'_{L(3,2)}$ $=0.5B_{L(3,2)}$ $+0.125B_{L(2,2)}$ $+0.125B_{L(4,2)}$ $+0.125B_{L(3,1)}$ $+0.125B_{L(3,3)}$ 361 | $G'_{H(3,2)}$ $=0.5G_{H(3,2)}$ $+0.125G_{H(2,2)}$ $+0.125G_{H(4,2)}$ $+0.125G_{H(3,1)}$ $+0.125G_{H(3,3)}$ 362 | $B'_{H(3,2)}$ $=0.5B_{H(3,2)}$ $+0.125B_{H(2,2)}$ $+0.125B_{H(4,2)}$ $+0.125B_{H(3,1)}$ $+0.125B_{H(3,3)}$ 363 |
| $B'_{L(2,3)}$ $=0.5B_{L(2,3)}$ $+0.125B_{L(1,3)}$ $+0.125B_{L(3,3)}$ $+0.125B_{L(2,2)}$ $+0.125B_{L(2,4)}$ 381 | $G'_{H(2,3)}$ $=0.5G_{L(2,3)}$ $+0.125G_{L(1,3)}$ $+0.125G_{L(3,3)}$ $+0.125G_{L(2,2)}$ $+0.125G_{L(2,4)}$ 382 | $B'_{H(2,3)}$ $=0.5B_{H(2,3)}$ $+0.125B_{H(1,3)}$ $+0.125B_{H(3,3)}$ $+0.125B_{H(2,2)}$ $+0.125B_{H(2,4)}$ 283 | $R_{(3,3)}$ 391 | $G'_{L(3,3)}$ $=0.5G_{L(3,3)}$ $+0.125G_{L(2,3)}$ $+0.125G_{L(4,3)}$ $+0.125G_{L(3,2)}$ $+0.125G_{L(3,4)}$ 392 | $R_{(3,3)}$ 393 |

36

| | | |
|---|---|---|
| $A_{R1}$= 0.0625 | $B_{R1}$= 0.0625 | $B_{R1}$=0 |
| $D_{R1}$= 0.375 | $E_{R1}$= 0.375 | $F_{R1}$=0 |
| $G_{R1}$= 0.0625 | $H_{R1}$= 0.0625 | $I_{R1}$=0 |

&

| | | |
|---|---|---|
| $A_{R2}$=0 | $B_{R2}$= 0.0625 | $C_{R2}$= 0.0625 |
| $D_{R2}$=0 | $E_{R2}$= 0.375 | $F_{R2}$= 0.375 |
| $G_{R2}$=0 | $H_{R2}$= 0.0625 | $I_{R2}$= 0.0625 |

Fig. 28

30

| | | | | | |
|---|---|---|---|---|---|
| $R'_{1(2,2)}$ $=0.375R_{(2,2)}$ $+0.375R_{(1,2)}$ $+0.0625R_{(2,1)}$ $+0.0625R_{(2,3)}$ $+0.0625R_{(1,1)}$ $+0.0625R_{(1,3)}$ <br> 351 | $G'_{L(2,2)}$ $=0.5G_{L(2,2)}$ $+0.125G_{L(1,2)}$ $+0.125G_{L(3,2)}$ $+0.125G_{L(2,1)}$ $+0.125G_{L(2,3)}$ <br> 352 | $R'_{2(2,2)}$ $=0.375R_{(2,2)}$ $+0.375R_{(3,2)}$ $+0.0625R_{(2,1)}$ $+0.0625R_{(2,3)}$ $+0.0625R_{(3,1)}$ $+0.0625R_{(3,3)}$ <br> 353 | $B'_{L(3,2)}$ $=0.5B_{L(3,2)}$ $+0.125B_{L(2,2)}$ $+0.125B_{L(4,2)}$ $+0.125B_{L(3,1)}$ $+0.125B_{L(3,3)}$ <br> 361 | $G'_{H(3,2)}$ $=0.5G_{H(3,2)}$ $+0.125G_{H(2,2)}$ $+0.125G_{H(4,2)}$ $+0.125G_{H(3,1)}$ $+0.125G_{H(3,3)}$ <br> 362 | $B'_{H(3,2)}$ $=0.5B_{H(3,2)}$ $+0.125B_{H(2,2)}$ $+0.125B_{H(4,2)}$ $+0.125B_{H(3,1)}$ $+0.125B_{H(3,3)}$ <br> 363 |
| $B'_{L(2,3)}$ $=0.5B_{L(2,3)}$ $+0.125B_{L(1,3)}$ $+0.125B_{L(3,3)}$ $+0.125B_{L(2,2)}$ $+0.125B_{L(2,4)}$ <br> 381 | $G'_{H(2,3)}$ $=0.5G_{L(2,3)}$ $+0.125G_{L(1,3)}$ $+0.125G_{L(3,3)}$ $+0.125G_{L(2,2)}$ $+0.125G_{L(2,4)}$ <br> 382 | $B'_{H(2,3)}$ $=0.5B_{H(2,3)}$ $+0.125B_{H(1,3)}$ $+0.125B_{H(3,3)}$ $+0.125B_{H(2,2)}$ $+0.125B_{H(2,4)}$ <br> 383 | $R'_{1(3,3)}$ <br> 391 | $G'_{L(3,3)}$ $=0.5G_{L(3,3)}$ $+0.125G_{L(2,3)}$ $+0.125G_{L(4,3)}$ $+0.125G_{L(3,2)}$ $+0.125G_{L(3,4)}$ <br> 392 | $R_{2(3,3)}$ <br> 393 |

Fig. 29

30

| | | | | | | | | | | | | | | | | | |
|---|---|---|---|---|---|---|---|---|---|---|---|---|---|---|---|---|---|
| | ① | | | | ② | | | | | | | | | | | | |
| R | G | R | B | G | B | R | G | R | B | G | B | R | G | R | B | G | B |
| B | G | B | R | G | R | B | G | B | R | G | R | B | G | B | R | G | R |
| R | G | R | B | G | B | R | G | R | B | G | B | R | G | R | B | G | B |
| B | G | B | R | G | R | B | G | B | R | G | R | B | G | B | R | G | R |
| R | G | R | B | G | B | R | G | R | B | G | B | R | G | R | B | G | B |
| B | G | B | R | G | R | B | G | B | R | G | R | B | G | B | R | G | R |

Fig. 30

| | | | | | | | | | | | | | | | | | |
|---|---|---|---|---|---|---|---|---|---|---|---|---|---|---|---|---|---|
| +R | +G | −R | −B | −G | +B | +R | +G | −R | −B | −G | +B | +R | +G | −R | −B | −G | +B |
| +B | +G | −B | −R | −G | +R | +B | +G | −B | −R | −G | +R | +B | +G | −B | −R | −G | +R |
| −R | −G | +R | +B | +G | −B | −R | −G | +R | +B | +G | −B | −R | −G | +R | +B | +G | −B |
| −B | −G | +B | +R | +G | −R | −B | −G | +B | +R | +G | −R | −B | −G | +B | +R | +G | −R |
| R | G | R | B | G | B | R | G | R | B | G | B | R | G | R | B | G | B |
| B | G | B | R | G | R | B | G | B | R | G | R | B | G | B | R | G | R |

. . .

Fig. 31

⋮

DISPLAYING METHOD AND IMAGE DISPLAY DEVICE

This application claims the benefit of Taiwan application Serial No. 94110114, filed Mar. 30, 2005, the entirety of which is incorporated herein by reference.

BACKGROUND OF THE INVENTION

1. Field of the Invention

The invention relates to a displaying method and an image display device, and more particularly, to a displaying method and image display device capable of improving the color shift phenomenon.

2. Description of the Prior Art

As incident lights passing through a liquid crystal layer from different angles generate different retardations, the refractive index of the light transmission will change according to different observation angles and result in different transmittance and different brightness while viewing from different angles. Hence, the light transmittance of a liquid crystal display being viewed from the front is different from the light transmittance of the same liquid crystal display being viewed from a side. Therefore, the brightness of the light will change according to the viewing angle. Additionally, a color shift phenomenon will result when different colors of light (such as red light, green light, and blue light) are combined at different brightness while viewing from the front and a side of the LCD. The degree of color shift among the three primary colors is as follows: blue light>green light>red light. Consequently, how to effectively improve this color shift phenomenon while viewing color displays from both front and sides has become an important task.

U.S. Pat. No. 5,717,474 to Kalluri, which is incorporated herein by reference, has suggested a display of dividing a pixel into a plurality of regions with different characteristics adapted for viewing from different angles. However, after the display is fabricated, no further adjustment can be made, and the fact that different regions correspond to different viewing angles specifically also reduces the quality of the display.

U.S. Pat. No. 5,847,688 to Sasumu, which is incorporated herein by reference, has suggested a method of utilizing different drivers to input the original signal within every two frames according to two gamma curves of different viewing angles. However, changes made within every two frames will result in flickering and only half of the pixels are actually involved in the displaying of an image at a particular viewing angle, thereby reducing the quality of the image and failing to solve the problems that occur in most observation circumstances.

U.S. Pat. No. 6,801,220 to Paul et al., which is incorporated herein by reference, has suggested a method of utilizing more than 2×2 subpixels to display an image, utilizing calculated values to adjust the original image, and utilizing bright and dark pixels of different ratios to complete a display. However, under the circumstances of utilizing a plurality of pixels to display various actions and treating each pixel as an individual unit, a resolution of greater than 170 dpi is required to solve problems such as color shift.

Please refer to FIG. 1. FIG. 1 is a diagram showing a conventional arrangement of the subpixels of a color display 10. As shown in FIG. 1, the conventional color display 10 (such as a liquid crystal display) includes a plurality of pixels 11 and 12 arranged in a matrix. Preferably, each of the pixels includes two red subpixels R, two green subpixels G, and two blue subpixels B, which are arranged in stripes. The pixel 11 includes a first red subpixel 111, a second red subpixel 112, a first green subpixel 113, a second green subpixel 114, a first blue subpixel 115, and a second blue subpixel 116.

Since the bright state signals and dark state signals have the low color shift characteristics, the conventional image display primarily divides a color subpixel into two smaller subpixels. The two smaller subpixels are driven by a bright state signal and a dark state signal and the combined gray scale is used for displaying the desired color, thereby improving the color shift under large viewing angles and expanding the overall viewing angles. As shown in FIG. 2, the first red subpixel 111 is driven by a bright state red signal, the second red subpixel 112 is driven by a dark state red signal. In FIG. 2, the cross hatching indicates the subpixels driven by dark state signals. The combined effect of the first red subpixel 111 and the second red subpixel 112 forms the desired red color of the first pixel 11 for improving the color shift and viewing angle of the red color of the first pixel 11. Similarly, the blue subpixels and the green subpixels are driven by the same method for improving the overall color shift problem and viewing angle of the first pixel 11.

The normalized light transmittance between a side-view and a front-view will differ even with color lights that have identical gray scales, thereby producing a color shift phenomenon. The difference of the normalized light transmittance between the side-view and the front-view decreases and reaches 0% as the gray scale reaches 0 or 255. Hence, for example, when the original gray scale of the blue pixel is 128, a dark state signal (hence, the dark state gray scale) can be selected as 0, and a bright state signal (hence, the bright state gray scale) can be selected as 190. The selected values, including both the bright state gray scale and the dark state gray scale, are utilized as a calibrated gray scale group to achieve the same visual effect as produced by the original gray scale. Since the difference of the normalized light transmittance between the side-view and the front-view of the calibrated gray scale group is significantly smaller than the difference of the normalized light transmittance between the side-view and the front-view of the original gray scale 128, the calibrated gray scale group can significantly reduce the color shift phenomenon on a liquid crystal display while maintaining an equivalent amount of brightness as the original gray scale.

The liquid crystal displays described involve the utilization of pixels, in which the subpixels driven by the bright state signals are concentrated in one row, whereas the subpixels driven by the dark state signals are concentrated in another row, as shown in FIG. 2. Consequently, stripes caused by uneven brightness will appear on the display image and result in unsatisfying visual effects. Additionally, the fact that the subpixels are not effectively arranged also reduces the sampling and rebuild ability of the image signals. Hence, the fabricated resolution must be doubled in order to achieve a resolution equivalent to the original fabricated resolution.

Therefore, how to develop an enhanced color display for solving the above-mentioned problems has become an important task.

SUMMARY OF THE INVENTION

It is therefore an objective of the present invention to provide a displaying method and an image display, which divide a gray scale into two and utilize the concept of pixel sharing to achieve a low color shift (LCS) display mode, thereby preventing phenomena such as color shift and uneven brightness.

In an aspect, there is provided a displaying method for use in an image display, wherein the image display comprises a plurality of pixels arranged in a matrix, each of the pixels comprises at least one subpixel of a primary color, the displaying method comprises receiving a plurality of image data, wherein each of the image data controls a corresponding pixel to display a color which corresponds to an original gray scale of said primary color; generating a first gray scale and a second gray scale from each said original gray scale; dividing subpixels of the same primary color into a first subpixel group and a second subpixel group, wherein the first subpixel group and the second subpixel group are staggered in a chessboard form; for each pixel having the subpixel belonging to the first group, utilizing the first gray scales of said pixel and the surrounding pixels to generate a first calibrated gray scale for said pixel; for each pixel having the subpixel belonging to the second group, utilizing the second gray scales of said pixel and the surrounding pixels to generate a second calibrated gray scale of said pixel; and utilizing a plurality of first voltages corresponding to the first calibrated gray scales to drive the corresponding subpixels of the first subpixel group, and a plurality of second voltages corresponding to the second calibrated gray scales to drive the corresponding subpixels of the second subpixel group.

In a further aspect, there is provided a displaying method for use in an image display, wherein the image display comprises a plurality of pixels arranged in a matrix, each pair of adjacent pixels together comprise six color subpixels arranged in one of the following orders: (a) a first-color subpixel, a second-color subpixel, a first-color subpixel, a third-color subpixel, a second-color subpixel, and a third-color subpixel, and (b) a third-color subpixel, a second-color subpixel, a third-color subpixel, a first-color subpixel, a second-color subpixel, and a first-color subpixel, wherein the second-color subpixels of adjacent rows are aligned, the first-color subpixels of adjacent rows are staggered, and the third-color subpixels of adjacent rows are also staggered, the displaying method comprising: receiving a plurality of image data, wherein each of the image data controls a corresponding pixel to display a color which corresponds to first-color, second-color, and third-color original gray scales for the first, second, and third colors, respectively; for each pixel having two first- or third-color subpixels, generating a first- or third-color calibrated gray scale according to the first- or third-color original gray scales of said pixel and the surrounding pixels; using the second-color original gray scale of each pixel as its second-color calibrated gray scale; and utilizing a plurality of voltages corresponding to the first-, second-, and third-color calibrated gray scales to drive the corresponding subpixels, wherein for each pixel having two first- or third-color subpixels, the same voltage is applied to said two first- or third-color subpixels via the same data line.

In a further aspect, there is provided a displaying method for use in an image display, wherein the image display comprises a plurality of pixels arranged in a matrix, each pair of adjacent pixels together comprise six color subpixels arranged in one of the following orders: (a) a third-color subpixel, a first-color subpixel, a third-color subpixel, a second-color subpixel, a first-color subpixel, and a second-color subpixel, and (b) a second-color subpixel, a first-color subpixel, a second-color subpixel, a third-color subpixel, a first-color subpixel, and a third-color subpixel, wherein the first-color subpixels of adjacent rows are aligned, the third-color subpixels of adjacent rows are staggered, and the second-color subpixels of adjacent rows are also staggered, the displaying method comprising: receiving a plurality of image data, wherein each of the image data controls a corresponding pixel to display a color which corresponds to first-color, second-color, and third-color original gray scales for the first, second, and third colors, respectively; generating a first gray scale and a second gray scale from each said first-color original gray scale; dividing the first-color subpixels into a first group and a second group, wherein the two adjacent first-color subpixels of each row of the first group are separated by five consecutive subpixels, the first-color subpixels of two adjacent rows of the first group are staggered, and the second group comprises the remaining first-color subpixels; for each pixel having the first-color subpixel belonging to the first group, utilizing the first gray scales of said pixel and the surrounding pixels to generate a first calibrated gray scale of the first color for said pixel; and for each pixel having the first-color subpixel belonging to the second group, utilizing the second gray scales of said pixel and the surrounding pixels to generate a second calibrated gray scale of the first color for said pixel; generating a third gray scale and a fourth gray scale from each said second-color original gray scale; dividing the second-color subpixels into a third group and a fourth group, wherein the two adjacent second-color subpixels of each row of the third group are separated by five consecutive subpixels, the second-color subpixels of two adjacent rows of the third group are staggered, and the fourth group comprises the remaining second-color subpixels; for each pixel having two second-color subpixels, utilizing the third gray scales of said pixel and the surrounding pixels to generate a third calibrated gray scale of the second color for said pixel; also for each pixel having two second-color subpixels, utilizing the fourth gray scales of said pixel and the surrounding pixels to generate a fourth calibrated gray scale of the second color for said pixel; and utilizing a plurality of first voltages corresponding to the first calibrated gray scales to drive the corresponding first-color subpixels of the first group, a plurality of second voltages corresponding to the second calibrated gray scales to drive the corresponding first-color subpixels of the second group, a plurality of third voltages corresponding to the third calibrated gray scales to drive the corresponding second-color subpixels of the third group, and a plurality of fourth voltages corresponding to the fourth calibrated gray scales to drive the corresponding second-color subpixels of the fourth group.

In a further aspect, there is provided a displaying method for use in an image display, wherein the image display comprises a plurality of pixels arranged in a matrix, each of the pixels comprises at least one subpixel of a primary color, the displaying method comprises: receiving a plurality of image data, wherein each of the image data controls a corresponding pixel to display a color which corresponds to an original gray scale of said primary color; generating a first gray scale and a second gray scale from each said original gray scale; dividing subpixels of the same primary color into a first subpixel group and a second subpixel group, wherein the first subpixel group and the second subpixel group are separated in a chessboard form; for each pixel having the subpixel belonging to the first group, utilizing the first gray scales of said pixel and the surrounding pixels to generate a first calibrated gray scale for said pixel; for each pixel having the subpixel belonging to the second group, utilizing the second gray scale of said pixel and the surrounding pixels to generate a second calibrated gray scale of said pixel; for each pixel, calculating a spatial frequency F based on the original gray scales of said pixel and the surrounding pixels; generating a distributed weight W according to a threshold T and the spatial frequency F; utilizing the first or the second calibrated gray scale and the original gray scale of the subpixel of said pixel to obtain an output gray scale of said pixel according to the distributed weight W; and utilizing a plurality of voltages corresponding to the output gray scales to drive the corresponding subpixels.

Also provided are displays in which the above methods are performed.

By utilizing a more advanced algorithm to process image signals, the present invention can provide an equivalent or even doubled image quality or resolution compared to the conventional process. Additionally, low color shift, uniform color distribution, and minimal black dots can be achieved under various viewing angles. Preferably, the displaying method of the present invention can be applied to both stripe type liquid crystal displays and staggered type liquid crystal displays. Consequently, the present invention can prevent color shift, and increase image brightness in the stripe type liquid crystal displays, and at the same time reduce the number of data drivers, preferably up to 33.33% in the staggered type liquid crystal displays. Moreover, the present invention can freely switch between the text mode and the LCS mode, and adjust the edge resolution of a displayed image, thereby producing a sharper picture.

These and other objectives of the present invention will become apparent to those of ordinary skill in the art after reading the following detailed description of the preferred embodiments with reference to the various figures and drawings.

BRIEF DESCRIPTION OF THE DRAWINGS

FIG. 28 is a diagram showing two lookup tables in accordance with an embodiment of the present invention.

FIG. 29 is a diagram showing the calibrated gray scale of a plurality of subpixels of the staggered type liquid crystal display.

FIG. 30 is a diagram showing the text mode of the staggered type liquid crystal display according to a displaying method of an embodiment of the present invention.

FIG. 31 is a diagram showing utilization of the driving circuit in accordance with the displaying method.

DETAILED DESCRIPTION

Figure 3:
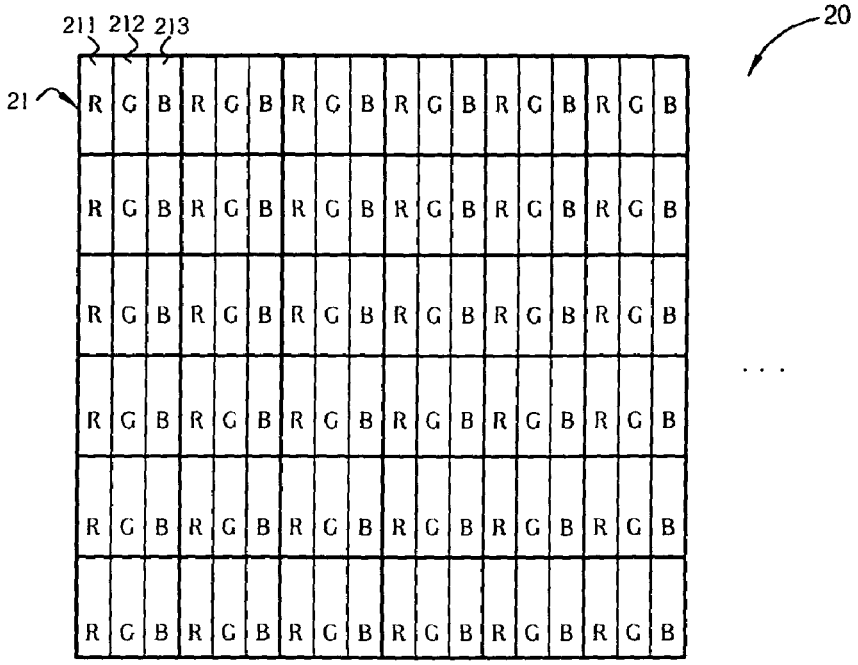
FIG. 3 is a diagram showing the stripe form pixel arrangement of a liquid crystal display in accordance with an embodiment.
Figure 4:
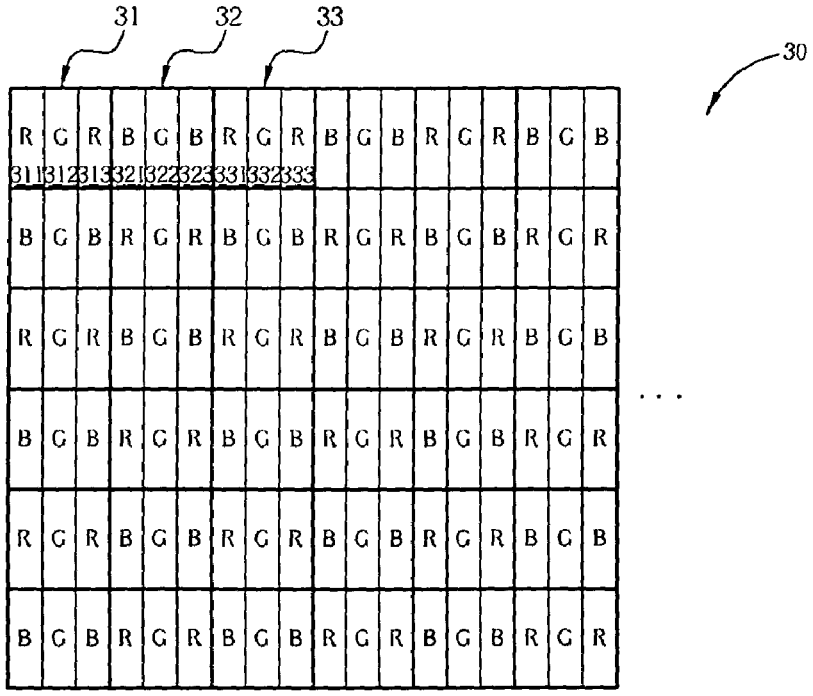
FIG. 4 is a diagram showing the staggered form pixel arrangement of a liquid crystal display in accordance with another embodiment.

The displaying method of the disclosed embodiments of the present invention applies to an image display, such as a liquid crystal display, in which the liquid crystal display includes a plurality of pixels arranged in a matrix form, and each of the pixels includes at least one color subpixel. Generally, there primary colors of red, blue and green are used, but the invention is not limited thereto. FIG. 3 and FIG. 4 are diagrams showing the pixel arrangement of liquid crystal displays 20 and 30, respectively.

As shown in FIG. 3, the pixels of the liquid crystal display 20 are arranged in a stripe form, in which each pixel, such as the pixel 21, includes, e.g., three subpixels arranged in the order of a red subpixel 211, a green subpixel 212, and a blue subpixel 213. As shown in the figure, R indicates red subpixel, G indicates green subpixel, and B indicates blue subpixel. The liquid crystal display 20 is a stripe form liquid crystal display because the red subpixels, blue subpixels and green subpixels are aligned in continuous columns or stripes, such as the vertical columns beginning at 211, 212, 213, respectively.

As shown in FIG. 4, the pixels of the liquid crystal display 30 are arranged in a staggered form, in which two adjacent pixels, such as pixels 31 and 32, include six subpixels arranged in the order of having a red subpixel 311, a green subpixel 312, a red subpixel 313, a blue subpixel 321, a green subpixel 322, and a blue subpixel 323. The two adjacent pixels 32 and 33, on the other hand, include six subpixels arranged in the order of having a blue subpixel 321, a green subpixel 322, a blue subpixel 323, a red subpixel 331, a green subpixel 332, and a red subpixel 333. In the liquid crystal display 30 which is a staggered form liquid crystal display, at least one of the primary colors has its subpixels arranged in a staggered manner. Preferably, the red subpixels and the blue subpixels are staggered every, e.g., two, rows and are not aligned with the same color subpixels in the row immediately below. In the particular embodiment of FIG. 4, the green subpixels remain aligned in continuous columns or stripes, such as the vertical columns beginning at 312, 322, 332, like FIG. 3.

The displaying method in accordance with an embodiment of the present invention includes the following steps.

First, a plurality of image data within a frame is received. Each image data controls a corresponding pixel in the frame to display a corresponding color. The corresponding color will be analyzed to obtain a gray scale for each primary color of the color subpixels within the pixel. Such gray scale is referred to as the original gray scale.

Figures 5, 6:
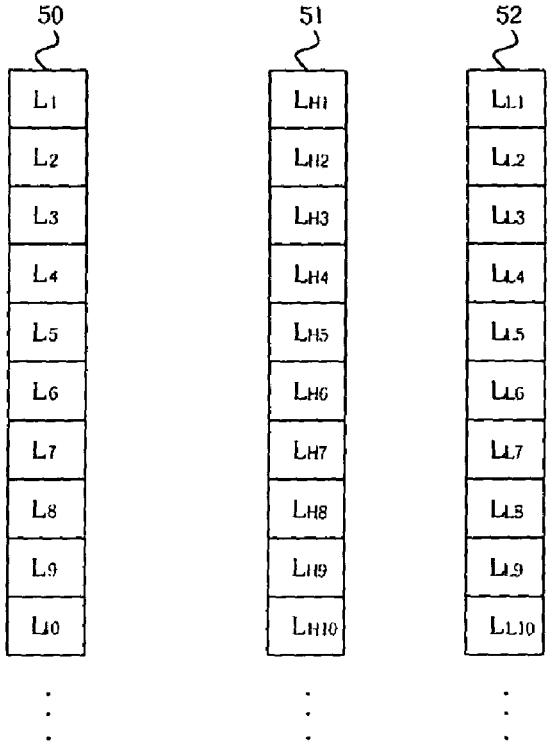
FIG. 5 is a diagram of a lookup table according to an embodiment of the present invention.
FIG. 6 is a diagram of a lookup table having different weights according to a further embodiment of the present invention.

Next, each original gray scale is utilized to generate a first gray scale and a second gray scale according to a lookup table, which is a database. For example, FIG. 5 illustrates a green color lookup table, in which the original gray scale group 50 includes every gray scale from 0 to 255. Each gray scale $L_i$ (i being a positive integer) corresponds to two gray scales $L_{Hi}$ and $L_{Li}$. All gray scales $L_{Hi}$, or first grey scales, belong to a higher gray scale group 51, whereas all gray scales $L_{Li}$, or second grey scales, belong to lower gray scale group 52. After the first and second gray scales are combined, a visual sensation produced by the original gray scale can be obtained, such that a user will be able to experience the same level of brightness as that produced by the original gray scale while viewing straight at the liquid crystal display, and also experience less color shift while viewing from different angles. For instance, when the original gray scale of the subpixel is 128, a bright state signal, such as the first gray scale of a value 190 and a dark state signal, such as the second gray scale of a value 0 can be selected. The lookup table can be adjusted according to the demand of a user, and different colors, such as red, green, or blue can utilize different lookup tables. Moreover, a data processor can be utilized as a gray scale generator and store the result in a memory.

Each pixel includes subpixels of different primary colors, and subpixels of the same primary color are divided into the first subpixel group and the second subpixel group. The division of the subpixels includes (i) arranging subpixels in a staggered and chessboard form within the first subpixel group, and (ii) arranging subpixels in a staggered and chessboard form within the second subpixel group, in which the first and second subpixel groups have a 180° phase shift spatially. The arrangements allow to utilize the space effectively and divide the subpixels of the same color into two groups, in which each group is utilized as different display signals within the display panel. In a nine-grid matrix, such as FIG. 6, five pixels, such as those designed with $B_H$, $D_H$, $F_H$, $H_H$ and $E_H$, are located inside the nine-grid matrix, in which one, such as that designed with $E_H$, of the pixels takes up the center of the nine-grid matrix whereas the four other pixels, such as those designed with $B_H$, $D_H$, $F_H$, $H_H$, are arranged around the central pixel. The corner pixels, such as those designed with $A_H$, $C_H$, $G_H$, $I_H$, are adjacent to the corners of the central pixel. Using this arrangement, the disclosed embodiment of the present invention can produce a much more uniform display image, obtain stronger image signal sampling and rebuild ability, and provide better image quality. However, it is within the scope of the present invention to use matrices of other sizes, such as four-grid or sixteen-grid matrices.

Next, another lookup table is provided, which is also a database and represented by a 3×3 or nine-grid matrix. The lookup table includes a plurality of values, such as nine weights $A_H$, $B_H$, $C_H$, $D_H$, $E_H$, $F_H$, $G_H$, $H_H$, and $I_H$. The sum of the nine weights is preferably 1 and the value for each weight can be set independently. As shown in FIG. 6, the nine weights correspond to the original gray scale of a color of the central pixel and the original gray scales of the colors of the eight pixels surrounding the central pixel. Since subpixels of the same color are divided into two groups and the subpixels within the two groups are arranged staggered to each other, a color subpixel within the central pixel and the same color subpixels of the four adjacent pixels located on the left, right, top, and bottom of the central pixel are not within the same subpixel group.

Next, the gray scale of each subpixel of the first subpixel group is calculated. Preferably, the gray scale is referred to as the calibrated gray scale $L'_{H(n,m)}$, in which m and n are positive integers corresponding to row and column of the pixel. Additionally, the original gray scale and the lookup table are utilized to calculate the calibrated gray scale via a convolution method. A data processor can be utilized as a calibrated gray scale generator and store the result in a memory. For example, the calculation is as follows:

$$L'_{H(n,m)} = \begin{bmatrix} L_{H(n-1,m-1)} & L_{H(n-1,m)} & L_{H(n-1,m+1)} \\ L_{H(n,m-1)} & L_{H(n,m)} & L_{H(n,m+1)} \\ L_{H(n+1,m-1)} & L_{H(n+1,m)} & L_{H(n+1,m+1)} \end{bmatrix} * \begin{bmatrix} A_H & B_H & C_H \\ D_H & E_H & F_H \\ G_H & H_H & I_H \end{bmatrix} = A_H \times L_{H(n-1,m-1)} + B_H \times L_{H(n-1,m)} + C_H \times L_{H(n-1,m+1)} + D_H \times L_{H(n,m-1)} + E_H \times L_{H(n,m)} + F_H \times L_{H(n,m+1)} + G_H \times L_{H(n+1,m-1)} + H_H \times L_{H(n+1,m)} + I_H \times L_{H(n+1,m+1)} \quad \text{Equation (1)}$$

Preferably, $L_{H(n-1,m-1)}$, $L_{H(n-1,m)}$, $L_{H(n-1,m+1)}$, $L_{H(n,m-1)}$, $L_{H(n,m)}$, $L_{H(n,m+1)}$, $L_{H(n+1,m-1)}$, $L_{H(n+1,m)}$ and $L_{H(n+1,m+1)}$ represent the corresponding first gray scales of the nine-grid matrix.

Additionally, provided is another lookup table (not shown), which is also a database and represented by a 3×3 matrix. The lookup table includes a plurality of values, such as nine weights $A_L$, $B_L$, $C_L$, $D_L$, $E_L$, $F_L$, $G_L$, $H_L$ and $I_L$. The sum of the nine weights is preferably 1 and the value for each weight can be set independently. Preferably, the nine weights correspond to the original gray scale of a color of the central pixel and the original gray scales of the colors of the eight pixels surrounding the central pixel. Since subpixels of the same color are divided into two groups and the subpixels within the two groups are arranged staggered to each other, a color subpixel within the central pixel and the same color subpixels of the four adjacent pixels located on the left, right, top, and bottom of the central pixel are not within the same subpixel group.

Next, the gray scale of each subpixel of the second subpixel group is calculated, in which the gray scale is referred to as the calibrated gray scale $L'_{L(n,m)}$. Additionally, the original gray scale and the lookup table are utilized to calculate the calibrated gray scale via a convolution method. A data processor is utilized as a calibrated gray scale generator to store the result in a memory. For example, the calculation is carried out as follows:

$$L'_{L(n,m)} = \begin{bmatrix} L_{L(n-1,m-1)} & L_{L(n-1,m)} & L_{L(n-1,m+1)} \\ L_{L(n,m-1)} & L_{L(n,m)} & L_{L(n,m+1)} \\ L_{L(n+1,m-1)} & L_{L(n+1,m)} & L_{L(n+1,m+1)} \end{bmatrix} * \begin{bmatrix} A_L & B_L & C_L \\ D_L & E_L & F_L \\ G_L & H_L & I_L \end{bmatrix} = A_L \times L_{L(n-1,m-1)} + B_L \times L_{L(n-1,m)} + C_L \times L_{L(n-1,m+1)} + D_L \times L_{L(n,m-1)} + E_L \times L_{L(n,m)} + F_L \times L_{L(n,m+1)} + G_L \times L_{L(n+1,m-1)} + H_L \times L_{L(n+1,m)} + I_L \times L_{L(n+1,m+1)} \quad \text{Equation (2)}$$

Preferably, $L_{L(n-1,m-1)}$, $L_{L(n-1,m)}$, $L_{L(n-1,m+1)}$, $L_{L(n,m-1)}$, $L_{L(n,m)}$, $L_{L(n,m+1)}$, $L_{L(n+1,m-1)}$, $L_{L(n+1,m)}$ and $L_{L(n+1,m+1)}$ represent the corresponding second gray scales of the nine-grid matrix.

Subsequently, a scan driver is utilized to initiate the subpixels and a data driver is utilized to drive the corresponding subpixels respectively with a plurality of voltages according to the calibrated gray scales within the frame, thereby completing the display within a frame.

Since the subpixels of the same color are divided into two groups, the subpixels of each group are disposed staggered to each other, and a color subpixel within the central pixel and the same color subpixels of the four adjacent pixels located on the left, right, top, and bottom of the central pixel are not within the same subpixel group. In other words, the adjacent pixels may not include subpixels of that color. Hence, the disclosed embodiment of the present invention utilizes the idea of pixel sharing to apply a weight distribution, in which the gray scale of a subpixel is calculated according to its original gray scale and the original gray scales of the same color subpixels located on the left, right, top, and bottom of the subpixel. Consequently, the displayed image is not significantly affected by the number of subpixels present.

I. An Embodiment According to the Displaying Method of the Present Invention

An embodiment according to the displaying method of the present invention is described below, in which a stripe type liquid crystal display shown in FIG. 3 is used.

Figure 7:
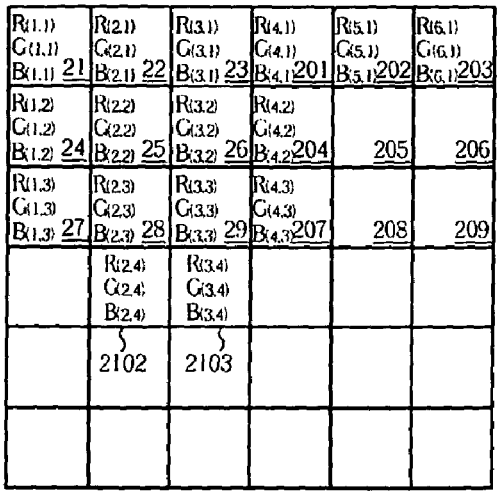
FIG. 7 is a diagram showing the corresponding gray scales of the red, green, and blue colors of image data.

First, a plurality of image data within a frame is received, and the image data is divided into original gray scales of three colors, red, green, and blue, as shown in FIG. 7. $R_{(n,m)}$, $G_{(n,m)}$ and $B_{(n,m)}$ represent the original gray scale of red, green, and blue according to the location of the pixel, where n and m are positive integers.

The original gray scale of each color listed above is utilized, using the lookup table shown in FIG. 5, to generate a first gray scale and a second gray scale. For instance, $R_{(n,m)}$ is utilized to generate $R_{H(n,m)}$ and $R_{L(n,m)}$, $G_{(n,m)}$ is utilized to generate $G_{H(n,m)}$ and $G_{L(n,m)}$, and $B_{(n,m)}$ is utilized to generate $B_{H(n,m)}$ and $B_{L(n,m)}$.

Figure 8:
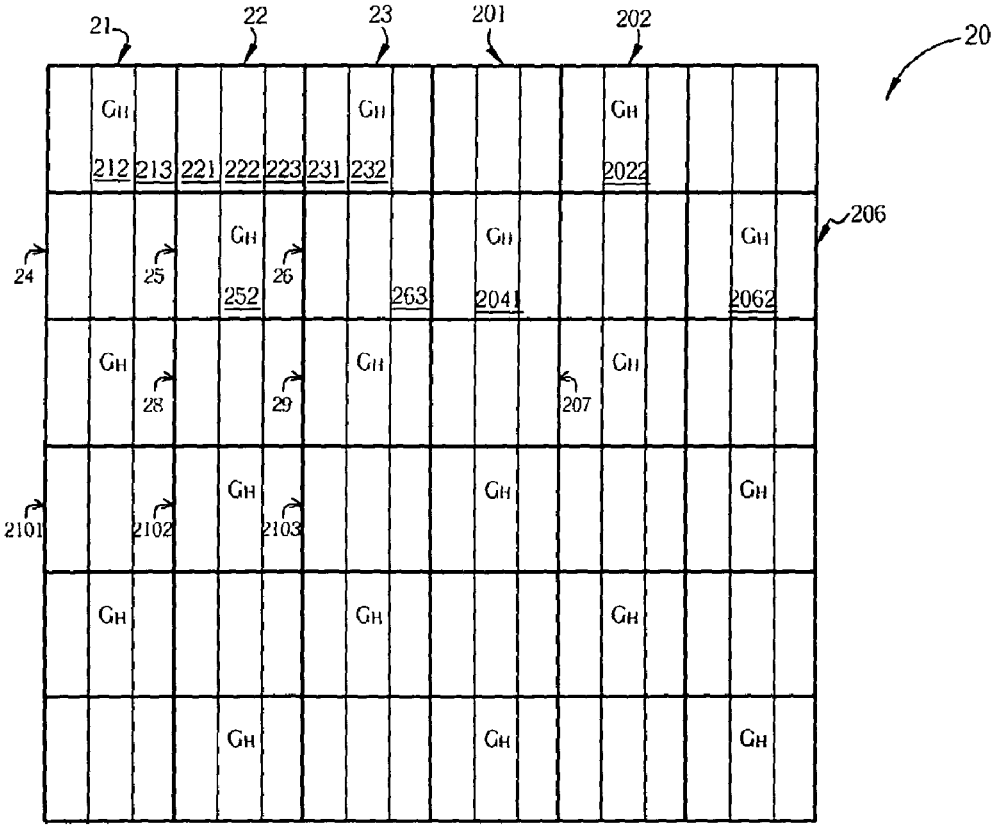
FIG. 8 and FIG. 9 are diagrams showing two green subpixel groups of the stripe type liquid crystal display.
Figure 9:
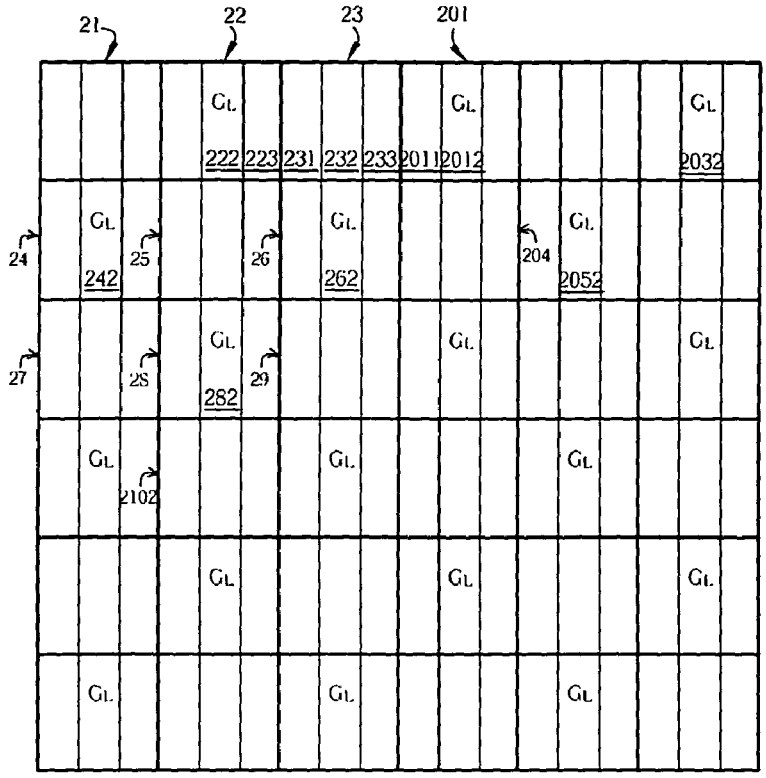

The green subpixel group of the display is divided into a first green subpixel group and a second green subpixel group, as shown in FIG. 8 and FIG. 9, respectively. The first green subpixel group shown in FIG. 8 displays the first gray scales, i.e., the higher gray scales. In the first green subpixel group, two of the adjacent green subpixels in each row are separated by five subpixels. For instance, the green subpixel 212 and the green subpixel 232 are separated by a blue subpixel 213, a red subpixel 221, a green subpixel 222, a blue subpixel 223, and a red subpixel 231. Additionally, the green subpixels of the two adjacent rows are staggered with respect to each other. For instance, the green subpixels 212, 232, and 2022 in the first row are staggered with respect to the green subpixels 252, 2041, and 2062 in the second row. Preferably, $G_H$ indicates the green subpixels of the first green subpixel group.

The second green subpixel group shown in FIG. 9 is composed of the remaining green subpixels, in which the second green subpixel group primarily displays the second gray scales, i.e., the lower gray scales. The arrangement the green subpixels of the second subpixel group is similar to the arrangement of the green subpixels of the first subpixel group. In the second green subpixel group, two of the adjacent green subpixels in each row are separated by five subpixels. For instance, the green subpixel 222 and the green subpixel 2012 are separated by the blue subpixel 223, the red subpixel 231, the green subpixel 232, the blue subpixel 233, and the red subpixel 2011. Additionally, the green subpixels of the two adjacent rows are staggered with respect to each other. For instance, the green subpixel 222, 2012, and 2032 in the first row are staggered with respect to the green subpixels 242, 262, and 2052 in the second row. Preferably, $G_L$ indicates the green subpixels of the second green subpixel group.

Figure 10:
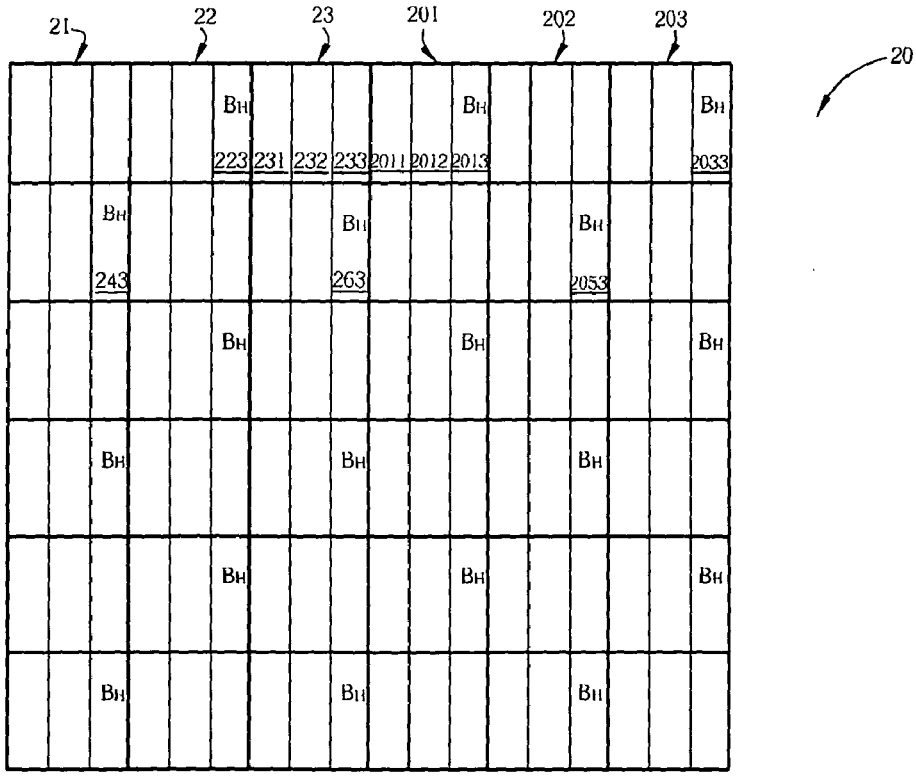
FIG. 10 and FIG. 11 are diagrams showing two blue subpixel groups of the stripe type liquid crystal display.
Figure 11:
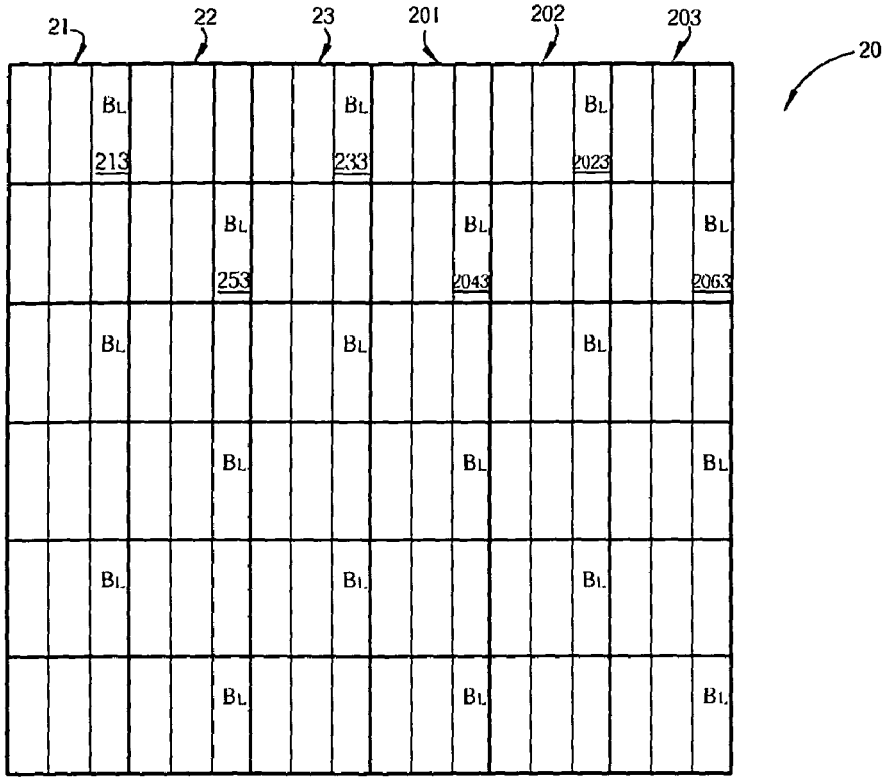

The blue subpixel group is divided into a first blue subpixel group and a second blue subpixel group, as shown in FIG. 10 and FIG. 11, respectively. The first blue subpixel group shown in FIG. 10 displays the first gray scales, i.e., the higher gray scales. In the first blue subpixel group, two of the adjacent blue subpixels in each row are separated by five subpixels. For instance, the blue subpixel 223 and the blue subpixel 2013 are separated by the subpixels 231, 232, 233, 2011, and 2012. Additionally, the blue subpixels of the two adjacent rows are staggered with respect to each other. For instance, the blue subpixels 223, 2013, and 2033 in the first row are staggered with respect to the blue subpixels 243, 263, and 2053 in the second row. Preferably, $B_H$ indicates the blue subpixels of the first blue subpixel group. The second blue subpixel group shown in FIG. 11 is composed of the remaining blue subpixels, in which the second blue subpixel group displays the second gray scales, i.e., the lower gray scales. The arrangement of the blue subpixels of the second blue subpixel group is similar to the arrangement of the blue subpixels from the first blue subpixel group, in which the blue subpixels 213, 233, and 2023 in the first row are staggered with respect to the blue subpixels 253, 2043, and 2063 in the second row. $B_L$ indicates the blue subpixels of the second blue subpixel group.

Next, the calibrated gray scale for each subpixel is set. However, the gray scales for the red subpixels will not be calibrated. Hence, the original gray scales of the red subpixels are their calibrated gray scales.

The setting of the gray scales for green subpixels and blue subpixels includes following steps:

First, a database, such as a lookup table, is provided as a filter table for the green color, in which the table includes a 3×3 matrix having nine weights $A_{GH}$, $B_{GH}$, $C_{GH}$, $D_{GH}$, $E_{GH}$, $F_{GH}$, $G_{GH}$, $H_{GH}$, and $I_{GH}$, in manner similar to FIG. 6. The sum of the nine weights is preferably 1 and the value for each weight can be set independently. For example, the calibrated gray scale $G'_{H(n,m)}$ for each green subpixel of the first green subpixel group is calculated according to the following equation:

$$G'_{H(n,m)} = \begin{bmatrix} G_{H(n-1,m-1)} & G_{H(n-1,m)} & G_{H(n-1,m+1)} \\ G_{H(n,m-1)} & G_{H(n,m)} & G_{H(n,m+1)} \\ G_{H(n+1,m-1)} & G_{H(n+1,m)} & G_{H(n+1,m+1)} \end{bmatrix} * \begin{bmatrix} A_{GH} & B_{GH} & C_{GH} \\ D_{GH} & E_{GH} & F_{GH} \\ G_{GH} & H_{GH} & I_{GH} \end{bmatrix} \quad \text{Equation (3)}$$

$$= A_{GH} \times G_{H(n-1,m-1)} + B_{GH} \times G_{H(n-1,m)} + C_{GH} \times G_{H(n-1,m+1)} + D_{GH} \times G_{H(n,m-1)} + E_{GH} \times G_{H(n,m)} + F_{GH} \times G_{H(n,m+1)} + G_{GH} \times G_{H(n+1,m-1)} + H_{GH} \times G_{H(n+1,m)} + I_{GH} \times G_{H(n+1,m+1)}$$

Preferably, $G_{H(n-1,m-1)}$, $G_{H(n-1,m)}$, $G_{H(n-1,m+1)}$, $G_{H(n,m-1)}$, $G_{H(n,m)}$, $G_{H(n,m+1)}$, $G_{H(n+1,m-1)}$, $G_{H(n+1,m)}$, and $G_{H(n+1,m+1)}$ represent the corresponding first gray scales of the green subpixels of the nine-grid matrix.

For instance, the corresponding weights include $A_{GH}=0$, $B_{GH}=0.125$, $C_{GH}=0$, $D_{GH}=0.125$, $E_{GH}=0.5$, $F_{GH}=0.125$, $G_{GH}=0$, $H_{GH}=0.125$, and $I_{GH}=0$, and the calibrated gray scale $G'_{H(2,2)}$ for the green subpixel 252 is calculated below:

$G_{H(2,2)}$(the first gray scale of the green color of the pixel 25)×0.5 ($E_{GH}$)+$G_{H(1,2)}$(the first gray scale of the green color of the left pixel 24)×0.125 ($D_{GH}$)+$G_{H(3,2)}$(the first gray scale of the green color of the right pixel 26)×0.125 ($F_{GH}$)+$G_{H(2,1)}$ (the first gray scale of the green color of the top pixel 22)×0.125($B_{GH}$)+$G_{H(2,3)}$(the first gray scale of the green color of the bottom pixel 28)×0.125 ($H_{GH}$)

Additionally, the calibrated $G'_{H(3,3)}$ for the green subpixel 292 is calculated as follows:

$G_{H(3,3)}$(the first gray scale of the green color of the pixel 29)×0.5 ($E_{GH}$)+$G_{H(2,3)}$(the first gray scale of the green color of the left pixel 28)×0.125 ($D_{GH}$)+$G_{H(4,3)}$(the first gray scale of the green color of the right pixel 207)×0.125 ($F_{GH}$)+$G_{H(3,2)}$ (the first gray scale of the green color of the top pixel 26)×0.125($B_{GH}$)+$G_{H(3,4)}$(the first gray scale of the green color of the bottom pixel 2103)× 0.125 ($H_{GH}$)

The calibrated gray scale $G'_{H(n,m)}$ for each green subpixel of the first green subpixel group is therefore calculated, and the calibrated gray scale represents a bright state.

The corresponding weights includes $A_{GH}=-0.0625$, $B_{GH}=0.125$, $C_{GH}=-0.0625$, $D_{GH}=0.125$, $E_{GH}=0.75$, $F_{GH}=0.125$, $G_{GH}=-0.0625$, $H_{GH}=0.125$, and $I_{GH}=-0.0625$, or, in an alternative embodiment, $A_{GH}=1/9$, $B_{GH}=1/9$, $C_{GH}=1/9$, $D_{GH}=1/9$, $E_{GH}=1/9$, $F_{GH}=1/9$, $G_{GH}=1/9$, $H_{GH}=1/9$, and $I_{GH}=1/9$. The weights can be adjusted according to the demand of various designs.

A database, such as a lookup table, is provided as a filter table for the second green subpixel group, in which the table includes a 3×3 matrix having nine weights $A_{GL}$, $B_{GL}$, $C_{GL}$, $D_{GL}$, $E_{GL}$, $F_{GL}$, $G_{GL}$, $H_{GL}$, and $I_{GL}$. The sum of the nine weights is preferably 1 and the value for each weight can be set independently. For example, the calibrated gray scale $G'_{L(n,m)}$ for each green subpixel of the second group is calculated according to the following equation:

$$G'_{L(n,m)} = \begin{bmatrix} G_{L(n-1,m-1)} & G_{L(n-1,m)} & G_{L(n-1,m+1)} \\ G_{L(n,m-1)} & G_{L(n,m)} & G_{L(n,m+1)} \\ G_{L(n+1,m-1)} & G_{L(n+1,m)} & G_{L(n+1,m+1)} \end{bmatrix} * \begin{bmatrix} A_{GL} & B_{GL} & C_{GL} \\ D_{GL} & E_{GL} & F_{GL} \\ G_{GL} & H_{GL} & I_{GL} \end{bmatrix} = A_{GL} \times G_{L(n-1,m-1)} + B_{GL} \times G_{L(n-1,m)} + C_{GL} \times G_{L(n-1,m+1)} + D_{GL} \times G_{L(n,m-1)} + E_{GL} \times G_{L(n,m)} + F_{GL} \times G_{L(n,m+1)} + G_{GL} \times G_{L(n+1,m-1)} + H_{GL} \times G_{L(n+1,m)} + I_{GL} \times G_{L(n+1,m+1)} \quad \text{Equation (4)}$$

Preferably, $G_{L(n-1,m-1)}$, $G_{L(n-1,m)}$, $G_{L(n-1,m+1)}$, $G_{L(n,m-1)}$, $G_{L(n,m)}$, $G_{L(n,m+1)}$, $G_{L(n+1,m-1)}$, $G_{L(n+1,m)}$ and $G_{L(n+1,m+1)}$ represent the corresponding second gray scales of the green subpixels of the nine-grid matrix.

For instance, the corresponding weights include $A_{GL}=0$, $B_{GL}=0.125$, $C_{GL}=0$, $D_{GL}=0.125$, $E_{GL}=0.5$, $F_{GL}=0.125$, $G_{GL}=0$, $H_{GL}=0.125$, and $I_{GL}=0$, and the calibrated gray scale $G'_{L(3,2)}$ for the green subpixel 262 is calculated below:

$G_{L(3,2)}$(the second gray scale of the green color of the pixel 26)×0.5 ($E_{GL}$)+$G_{L(2,2)}$(the second gray scale of the green color of the left pixel 25)×0.125 ($D_{GL}$)+$G_{L(4,2)}$(the second gray scale of the green color of the right pixel 204)×0.125 ($F_{GL}$)+$G_{L(3,1)}$(the second gray scale of the green color of the top pixel 23)×0.125 ($B_{GL}$)+$G_{L(3,3)}$ (the second gray scale of the green color of the bottom pixel 29)×0.125($H_{GL}$)

Additionally, the calibrated gray scale $G'_{L(2,3)}$ for the green subpixel 282 is calculated as follows:

$G_{L(2,3)}$(the second gray scale of the green color of the pixel 28)×0.5 ($E_{GL}$)+$G_{L(1,3)}$(the second gray scale of the green color of the left pixel 27)×0.125 ($D_{GL}$)+$G_{L(3,3)}$(the second gray scale of the green color of the right pixel 29)×0.125 ($F_{GL}$)+$G_{L(2,2)}$(the second gray scale of the green color of the top pixel 25)×0.125 ($B_{GL}$)+$G_{L(2,4)}$ (the second gray scale of the green color of the bottom pixel 2102)×0.125($H_{GL}$)

The calibrated gray scale $G'_{L(n,m)}$ for each green subpixel of the second green subpixel group is therefore calculated, and the calibrated gray scale represents a dark state.

The gray scales for the first blue subpixel group shown in FIG. 10 are also adjusted to generate the corresponding calibrated gray scales. A database, such as a lookup table, is provided as a filter table for the blue color, in which the table includes a 3×3 matrix having nine weights $A_{BH}$, $B_{BH}$, $C_{BH}$, $D_{BH}$, $E_{BH}$, $F_{BH}$, $G_{BH}$, $H_{BH}$, and $I_{BH}$. The sum of the nine weights is preferably 1 and the value for each weight can be set independently. For example, the calibrated gray scale $B'_{H(n,m)}$ for each blue subpixel of the first group, representing a bright state display, is calculated according to the following equation:

$$B'_{H(n,m)} = \begin{bmatrix} B_{H(n-1,m-1)} & B_{H(n-1,m)} & B_{H(n-1,m+1)} \\ B_{H(n,m-1)} & B_{H(n,m)} & B_{H(n,m+1)} \\ B_{H(n+1,m-1)} & B_{H(n+1,m)} & B_{H(n+1,m+1)} \end{bmatrix} * \begin{bmatrix} A_{BH} & B_{BH} & C_{BH} \\ D_{BH} & E_{BH} & F_{BH} \\ G_{BH} & H_{BH} & I_{BH} \end{bmatrix} = A_{BH} \times B_{H(n-1,m-1)} + B_{BH} \times B_{H(n-1,m)} + C_{BH} \times B_{H(n-1,m+1)} + D_{BH} \times B_{H(n,m-1)} + E_{BH} \times B_{H(n,m)} + F_{BH} \times B_{H(n,m+1)} + G_{BH} \times B_{H(n+1,m-1)} + H_{BH} \times B_{H(n+1,m)} + I_{BH} \times B_{H(n+1,m+1)} \quad \text{Equation (5)}$$

Preferably, $B_{H(n-1,m-1)}$, $B_{H(n-1,m)}$, $B_{H(n-1,m+1)}$, $B_{H(n,m-1)}$, $B_{H(n,m)}$, $B_{H(n,m+1)}$, $B_{H(n+1,m-1)}$, $B_{H(n+1,m)}$ and $B_{H(n+1,m+1)}$ represent the corresponding first gray scales of the blue subpixels of the nine-grid matrix.

The gray scales for the second blue subpixel group shown in FIG. 11 are also adjusted to generate the corresponding calibrated gray scales. A database, such as a lookup table, is provided as a filter table for the blue color, in which the table includes a 3×3 matrix having nine weights $A_{BL}$, $B_{BL}$, $C_{BL}$, $D_{BL}$, $E_{BL}$, $F_{BL}$, $G_{BL}$, $H_{BL}$, and $I_{BL}$. The sum of the nine weights is preferably 1 and the value for each weight can be set independently. For example, the calibrated gray scale $B'_{L(n,m)}$ for each blue subpixel of the second group, representing a dark state display, is calculated according to the following equation:

$$B'_{L(n,m)} = \begin{bmatrix} B_{L(n-1,m-1)} & B_{L(n-1,m)} & B_{L(n-1,m+1)} \\ B_{L(n,m-1)} & B_{L(n,m)} & B_{L(n,m+1)} \\ B_{L(n+1,m-1)} & B_{L(n+1,m)} & B_{L(n+1,m+1)} \end{bmatrix} * \begin{bmatrix} A_{BL} & B_{BL} & C_{BL} \\ D_{BL} & E_{BL} & F_{BL} \\ G_{BL} & H_{BL} & I_{BL} \end{bmatrix} = A_{BL} \times B_{L(n-1,m-1)} + B_{BL} \times B_{L(n-1,m)} + C_{BL} \times B_{L(n-1,m+1)} + D_{BL} \times B_{L(n,m-1)} + E_{BL} \times B_{L(n,m)} + F_{BL} \times B_{L(n,m+1)} + G_{BL} \times B_{L(n+1,m-1)} + H_{BL} \times B_{L(n+1,m)} + I_{BL} \times B_{L(n+1,m+1)} \quad \text{Equation (6)}$$

Preferably, $B_{L(n-1,m-1)}$, $B_{L(n-1,m)}$, $B_{L(n-1,m+1)}$, $B_{L(n,m-1)}$, $B_{L(n,m)}$, $B_{L(n,m+1)}$, $B_{L(n+1,m-1)}$), $B_{L(n+1,m)}$, and $B_{L(n+1,m+1)}$ represent the corresponding second gray scales of the blue subpixels of the nine-grid matrix.

Figure 12:
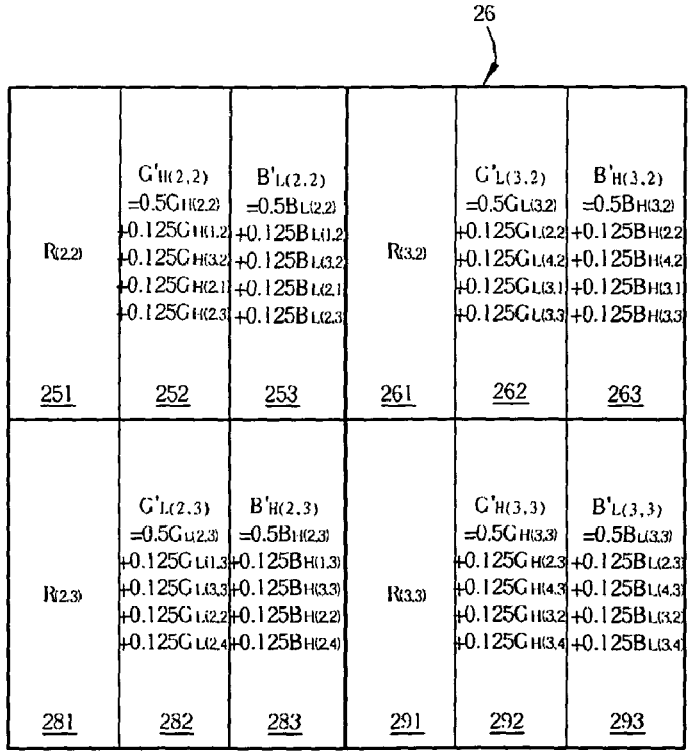
FIG. 12 is a diagram showing the calibrated gray scale of a plurality of subpixels of the stripe type liquid crystal display.

Hence, the calibrated gray scales for each blue subpixel of the first blue subpixel group and the second blue subpixel group can be calculated. For instance, the corresponding weights include $A_{BH}$=0, $B_{BH}$=0.125, $C_{BH}$=0, $D_{BH}$=0.125, $E_{BH}$=0.5, $F_{BH}$=0.125, $G_{BH}$=0, $H_{BH}$=0.125 and $I_{BH}$=0, and $A_{BL}$=0, $B_{BL}$=0.125, $C_{BL}$=0, $D_{BL}$=0.125, $E_{BL}$=0.5, $F_{BL}$=0.125, $G_{BL}$=0, $H_{BL}$=0.125 and $I_{BL}$=0, and the calibrated gray scales of the subpixels 252, 253, 262, 263, 282, 283, 292, and 293 from FIG. 8 through FIG. 11 are shown in FIG. 12.

Figure 1:
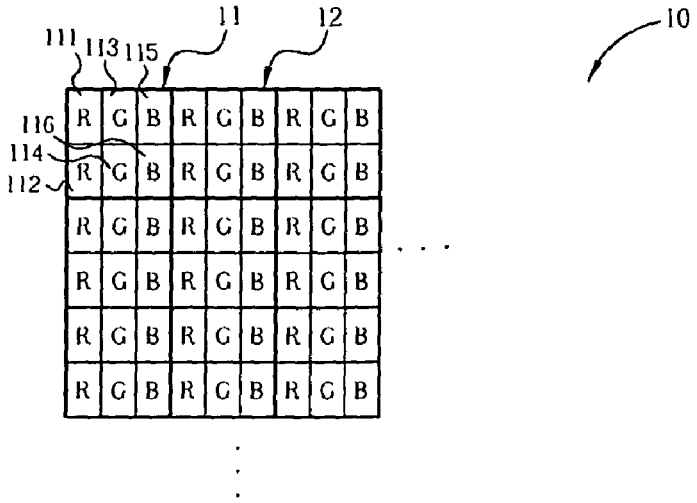
Fig. 1 Prior Art
FIG. 1 is a diagram showing a conventional arrangement of subpixels of a color display.
Figure 2:
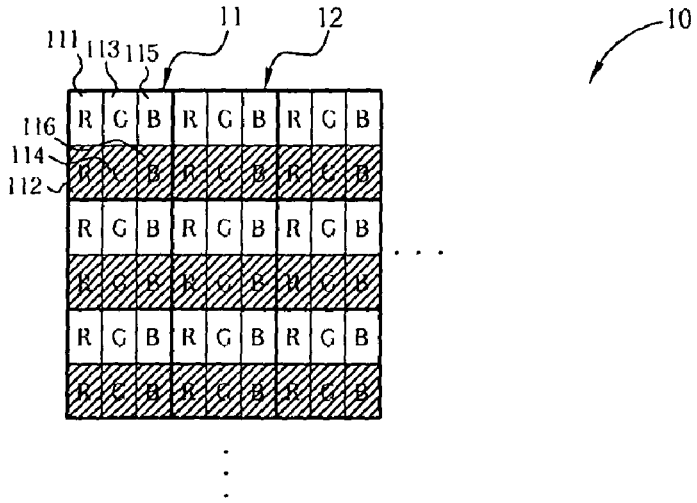
Fig. 2 Prior Art
FIG. 2 is a diagram showing the displaying result of the color display shown in FIG. 1.
Figure 13:
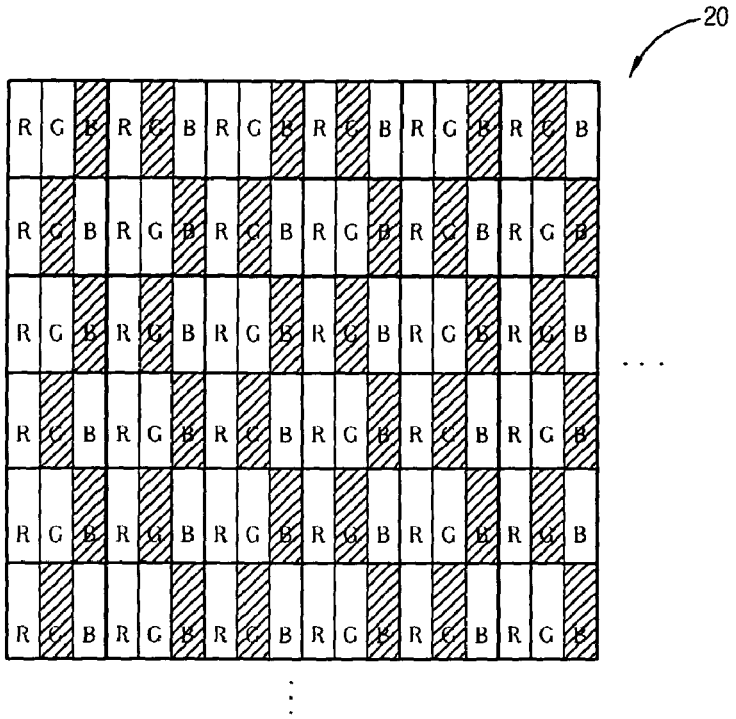
FIG. 13 is a diagram showing the displayed image of the stripe type liquid crystal display.

Subsequently, a plurality of voltages corresponding to the calibrated gray scales generated above are utilized to drive the corresponding subpixels within the frame and complete the display of the image. FIG. 13 illustrates the displaying result after calibrating the gray scales in the stripe type liquid crystal display shown in FIG. 3. Additionally, the figure shows the distribution of the subpixels driven by dark state signals and bright state signals, in which the subpixels driven by dark state signals are cross-hatched. Preferably, the subpixels driven by the dark state signals are uniformly distributed within the image and not concentrated in a particular region, thereby significantly improving the uneven brightness problem shown in FIG. 2, and maintaining a lower color shift and a better viewing angle that are achieved by the driving of both bright state signals and dark state signals.

Since the red color generates the minimum amount of color shift from different viewing angles, the gray scales corresponding to the red subpixels in the above disclosed embodiment are not adjusted. Hence, the red color is directly displayed with the original gray scales and produces an image that is closer to the input data.

II. Another Embodiment According to the Displaying Method of the Present Invention Another embodiment according to the displaying method of the present invention is described below, in which the stripe type liquid crystal display shown in FIG. 3 is used. In the present embodiment, the gray scale of the red subpixels are calibrated in addition to the calibration of the gray scales of the green subpixels and the blue subpixels described above.

Figure 14:
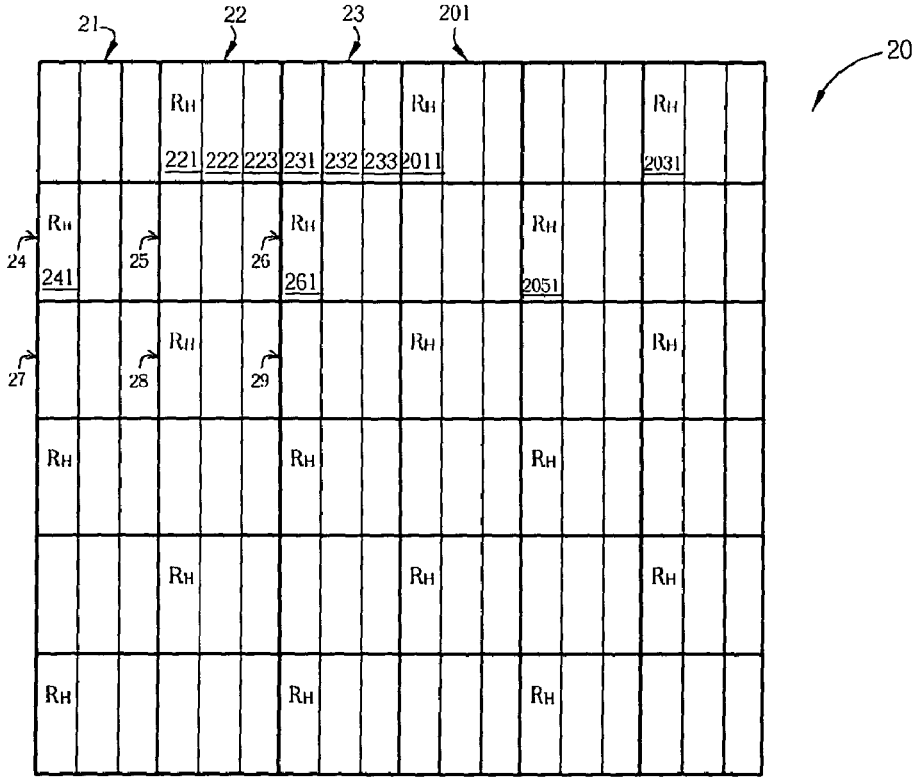
FIG. 14 and FIG. 15 are diagrams showing two red subpixel groups of the stripe type liquid crystal display.
Figure 15:
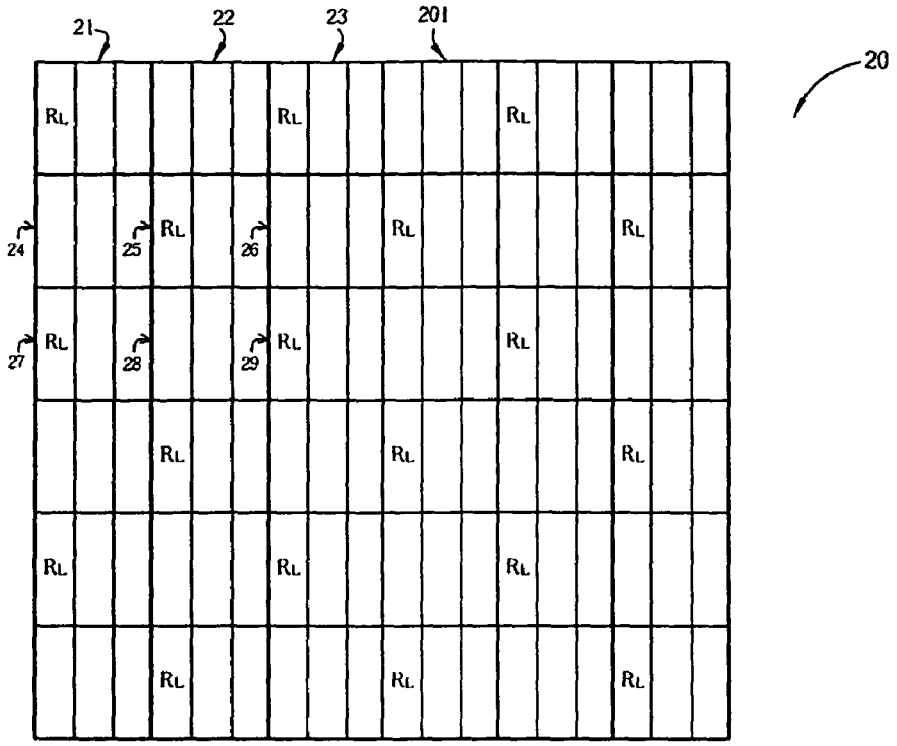

The red subpixels of the display are divided into a first red subpixel group and a second red subpixel group, as shown in FIG. 14 and FIG. 15, respectively. The first red subpixel group shown in FIG. 14 displays the first gray scales, i.e., the higher gray scales labeled as $R_H$. In the first red subpixel group, two of the adjacent red subpixels of each row are separated by five subpixels. For instance, the red subpixel 221 and the red subpixel 2011 are separated by the green subpixel 222, the blue subpixel 223, the red subpixel 231, the green subpixel 232, and the blue subpixel 233. Additionally, the red subpixels of the two adjacent rows are staggered with respect to each other. For instance, the red subpixels 221, 2011, and 2031 in the first row are staggered with respect to the red subpixels 241, 261, and 2051 in the second row.

The second red subpixel group shown in FIG. 15 is composed of the remaining red subpixels. Preferably, the second red subpixel group displays the second gray scales, i.e., the lower gray scales labeled as $R_L$. The arrangement of the red subpixels in the second red subpixel group is similar to the arrangement of the red subpixels in the first red subpixel group.

Similarly, a database, such as a lookup table, is provided as a filter table for the red color, in which the table includes a 3×3 matrix having nine weights $A_{RH}$, $B_{RH}$, $C_{RH}$, $D_{RH}$, $E_{RH}$, $F_{RH}$, $G_{RH}$, $H_{RH}$, and $I_{RH}$. The sum of the nine weights is preferably 1 and the value for each weight can be set independently. For example, the calibrated gray scale $R'_{H(n,m)}$ for each red subpixel of the first group is calculated according to the following equation:

$$R'_{H(n,m)} = \begin{bmatrix} R_{H(n-1,m-1)} & R_{H(n-1,m)} & R_{H(n-1,m+1)} \\ R_{H(n,m-1)} & R_{H(n,m)} & R_{H(n,m+1)} \\ R_{H(n+1,m-1)} & R_{H(n+1,m)} & R_{H(n+1,m+1)} \end{bmatrix} * \begin{bmatrix} A_{RH} & B_{RH} & C_{RH} \\ D_{RH} & E_{RH} & F_{RH} \\ G_{RH} & H_{RH} & I_{RH} \end{bmatrix} = A_{RH} \times R_{H(n-1,m-1)} + B_{RH} \times R_{H(n-1,m)} + C_{RH} \times R_{H(n-1,m+1)} + D_{RH} \times R_{H(n,m-1)} + E_{RH} \times R_{H(n,m)} + F_{RH} \times R_{H(n,m+1)} + G_{RH} \times R_{H(n+1,m-1)} + H_{RH} \times R_{H(n+1,m)} + I_{RH} \times R_{H(n+1,m+1)} \quad \text{Equation (7)}$$

Preferably, $R_{H(n-1,m-1)}$, $R_{H(n-1,m)}$, $R_{H(n-1,m+1)}$, $R_{H(n,m-1)}$, $R_{H(n,m)}$, $R_{H(n,m+1)}$, $R_{H(n+1,m-1)}$, $R_{H(n+1,m)}$, and $R_{H(n+1,m+1)}$ represent the corresponding first gray scales of the red subpixels of the nine-grid matrix.

For instance, the corresponding weights include $A_{RH}$=0, $B_{RH}$=0.125, $C_{RH}$=0, $D_{RH}$=0.125, $E_{RH}$=0.5, $F_{RH}$=0.125, $G_{RH}$=0, $H_{RH}$=0.125, and $I_{RH}$=0, and the calibrated gray scale $R'_{H(3,2)}$ for the red subpixel 261 is calculated below:

$R_{H(3,2)}$(the first gray scale of the red color of the pixel 26)×0.5 ($E_{GH}$)+$R_{H(2,2)}$(the first gray scale of the red color of the left pixel 25)×0.125 ($D_{GH}$)+$R_{H(4,2)}$(the first gray scale of the red color of the right pixel 204)×0.125 ($F_{GH}$)+$R_{H(3,1)}$(the first gray scale of the red color of the pixel 23)×0.125 ($B_{GH}$)+$R_{H(3,3)}$(the first gray scale of the red color of the pixel 29)×0.125 ($H_{GH}$)

The calibrated gray scale $R'_{H(n,m)}$ for each red subpixel of the first red subpixel group is therefore calculated, and the calibrated gray scale represents a bright state.

Additionally, another database, such as a lookup table, is provided as a filter table for the second red subpixel group, and the table includes a 3×3 matrix having nine weights $A_{RL}$, $B_{RL}$, $C_{RL}$, $D_{RL}$, $E_{RL}$, $F_{RL}$, $G_{RL}$, $H_{RL}$, and $I_{RL}$. The sum of the nine weights is preferably 1 and the value for each weight can be set independently. For example, the calibrated gray scale $R'_{L(n,m)}$ for each red subpixel of the second group is calculated according to the following equation:

$$R'_{L(n,m)} = \begin{bmatrix} R_{L(n-1,m-1)} & R_{L(n-1,m)} & R_{L(n-1,m+1)} \\ R_{L(n,m-1)} & R_{L(n,m)} & R_{L(n,m+1)} \\ R_{L(n+1,m-1)} & R_{L(n+1,m)} & R_{L(n+1,m+1)} \end{bmatrix} * \begin{bmatrix} A_{RL} & B_{RL} & C_{RL} \\ D_{RL} & E_{RL} & F_{RL} \\ G_{RL} & H_{RL} & I_{RL} \end{bmatrix} = A_{RL} \times R_{L(n-1,m-1)} + B_{RL} \times R_{L(n-1,m)} + C_{RL} \times R_{L(n-1,m+1)} + D_{RL} \times R_{L(n,m-1)} + E_{RL} \times R_{L(n,m)} + F_{RL} \times R_{L(n,m+1)} + G_{RL} \times R_{L(n+1,m-1)} + H_{RL} \times R_{L(n+1,m)} + I_{RL} \times R_{L(n+1,m+1)} \quad \text{Equation (8)}$$

Preferably, $R_{L(n-1,m-1)}$, $R_{L(n-1,m)}$, $R_{L(n-1,m+1)}$, $R_{L(n,m-1)}$, $R_{L(n,m)}$, $R_{L(n,m+1)}$, $R_{L(n+1,m-1)}$, $R_{L(n+1,m)}$, and $R_{L(n+1,m+1)}$ represent the corresponding second gray scales of the red subpixels of the nine-grid matrix.

For instance, the corresponding nine weights include $A_{RL}=0$, $B_{RL}=0.125$, $C_{RL}=0$, $D_{RL}=0.125$, $E_{RL}=0.5$, $F_{RL}=0.125$, $G_{RL}=0$, $H_{RL}=0.125$, and $I_{RL}=0$, and the calibrated value $R'_{L(2,2)}$ for the red subpixel 251 is calculated below:

$R_{L(2,2)}$(the second gray scale of the red color of the pixel 25)×0.5 ($E_{RL}$)+$R_{L(1,2)}$(the second gray scale of the red color of the left pixel 24)×0.125 ($D_{RL}$)+$R_{L(3,2)}$(the second gray scale of the red color of the right pixel 26)×0.125 ($F_{RL}$)+$R_{L(2,1)}$ (the second gray scale of the red color of the top pixel 22)×0.125 ($B_{RL}$)+$R_{L(2,3)}$(the second gray scale of the red color of the bottom pixel 28)× 0.125 ($H_{RL}$)

The calibrated gray scale $R'_{L(n,m)}$ for each red subpixel of the second red subpixel group is therefore calculated, and the calibrated gray scale represents a dark state.

Figure 16:
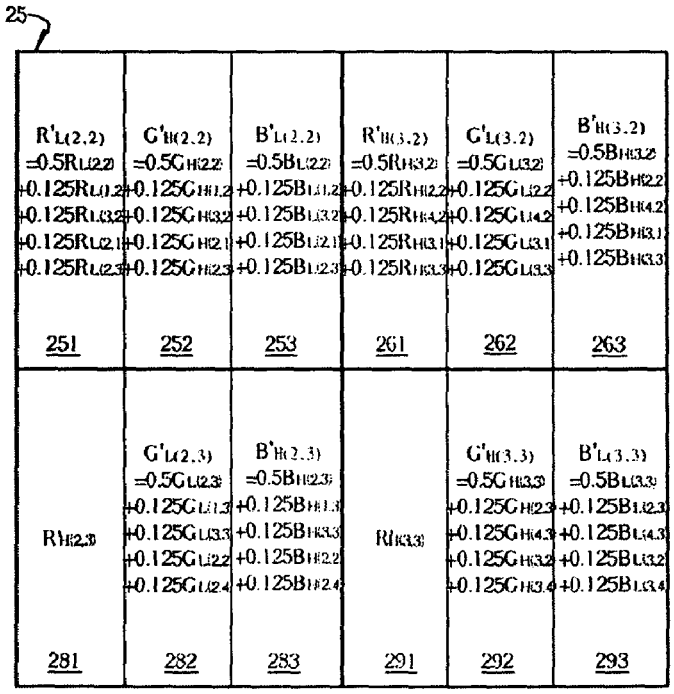
FIG. 16 is a diagram showing the calibrated gray scale of a plurality of subpixels of the stripe type liquid crystal display.

The calibrated gray scales of the subpixels 251, 252, 253, 261, 262, 263, 282, 283, 292, and 293 from FIG. 8 through FIG. 11 and FIG. 14 through FIG. 15 are shown in FIG. 16.

Figure 17:
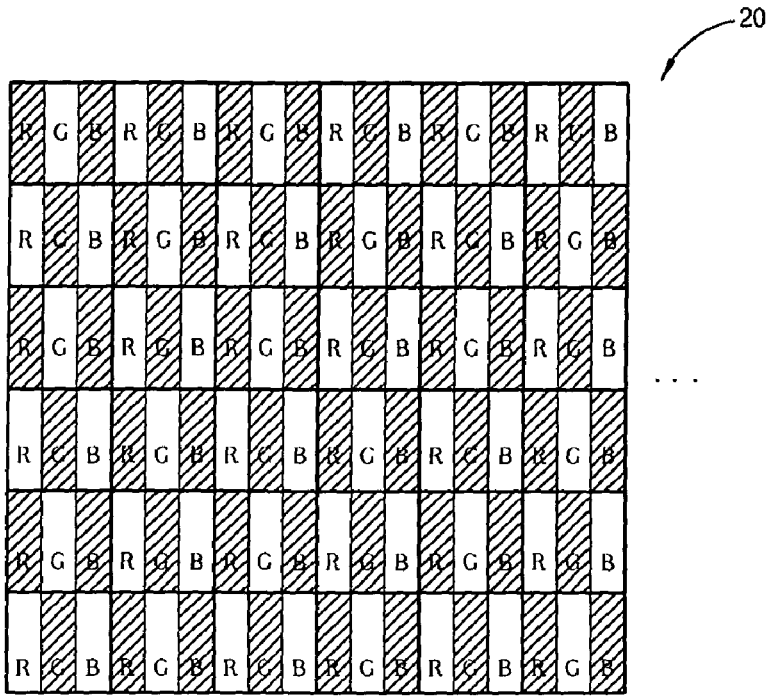
FIG. 17 is a diagram showing the displayed image of the stripe type liquid crystal display.

Subsequently, a plurality of voltages corresponding to the calibrated gray scales of the red, green, and blue colors generated above are utilized to drive the corresponding subpixels within the frame and complete the display of the image. FIG. 17 illustrates the displaying result after calibrating the gray scales in the stripe type liquid crystal display shown in FIG. 3. Additionally, the figure shows the distribution of the subpixels driven by dark state signals and bright state signals, in which the subpixels driven by dark state signals are cross-hatched. Preferably, the subpixels driven by the dark state signals are uniformly distributed within the image and not concentrated in a particular region, thereby significantly improving the uneven brightness problem shown in FIG. 2, and maintaining a better color shift and a viewing angle that are achieved by the driving of both bright state signals and dark state signals.

Figure 18:
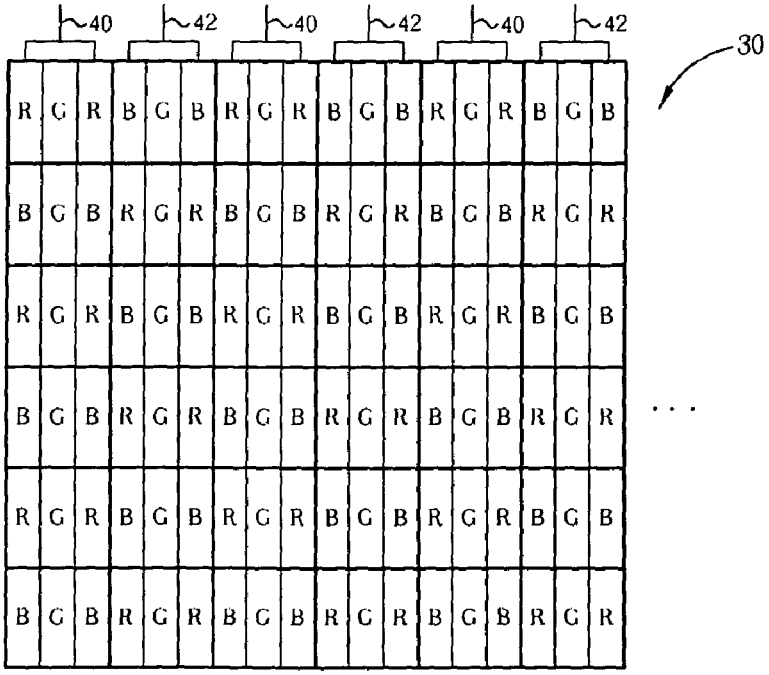
FIG. 18 is a diagram showing the staggered type liquid crystal display of FIG. 4 with further details.

III. Another Embodiment According to the Displaying Method of the Present Invention FIG. 18 illustrates another embodiment of the displaying method according to the present invention using the staggered type liquid crystal display shown in FIG. 4. First, a plurality of image data are received within a frame, and each image data is utilized to control a corresponding pixel within the frame to display a corresponding, original gray scale for each color.

Next, the calibrated gray scale corresponding to each subpixel is determined, in which the signals for two red subpixels of each pixel are applied by the same data line 40.

A lookup table, such as a database, is provided for the red color, in which the table includes a 3×3 matrix having nine weights $A_R$, $B_R$, $C_R$, $D_R$, $E_R$, $F_R$, $G_R$, $H_R$, and $I_R$. The sum of the nine weights is preferably 1 and the value for each weight can be set independently. Due to the special arrangement of the staggered type liquid crystal display, the four pixels located on the left, right, top, and bottom of the current red subpixel may not include any red subpixel.

Figure 19:
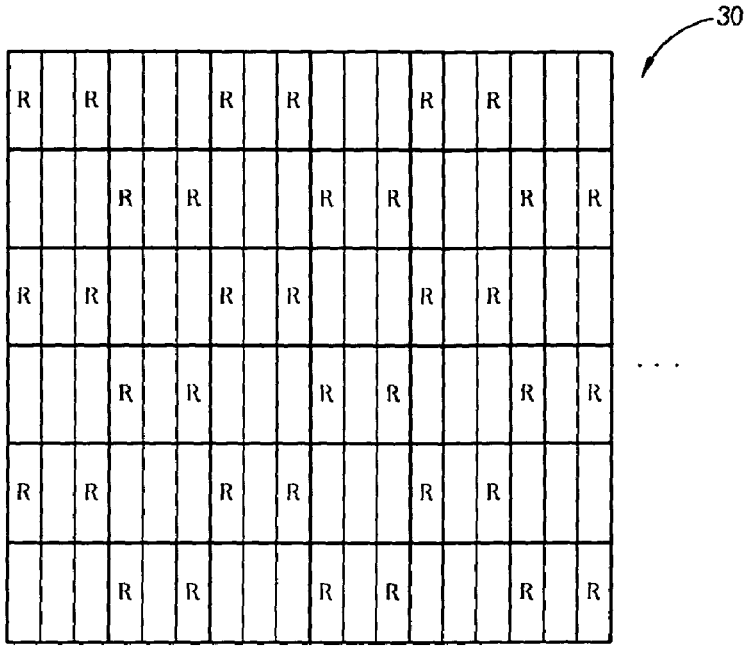
FIG. 19 and FIG. 20 are diagrams showing the red subpixels and blue subpixels of the staggered type liquid crystal display.

Next, all of the red subpixels are combined into one group, as shown in FIG. 19, and the gray scale for each red subpixel, referred to as $R'_{(n,m)}$, is calculated by a data processor and the result is stored in a memory. For example, the calculation is performed according to the following equation:

$$R'_{(n,m)} = \begin{bmatrix} R_{(n-1,m-1)} & R_{(n-1,m)} & R_{(n-1,m+1)} \\ R_{(n,m-1)} & R_{(n,m)} & R_{(n,m+1)} \\ R_{(n+1,m-1)} & R_{(n+1,m)} & R_{(n+1,m+1)} \end{bmatrix} * \begin{bmatrix} A_R & B_R & C_R \\ D_R & E_R & F_R \\ G_R & H_R & I_R \end{bmatrix} = A_R \times R_{(n-1,m-1)} + B_R \times R_{(n-1,m)} + C_R \times R_{(n-1,m+1)} + D_R \times R_{(n,m-1)} + E_R \times R_{(n,m)} + F_R \times R_{(n,m+1)} + G_R \times R_{(n+1,m-1)} + H_R \times R_{(n+1,m)} + I_R \times R_{(n+1,m+1)} \quad \text{Equation (9)}$$

Preferably, $R_{(n-1,m-1)}$, $R_{(n-1,m)}$, $R_{(n-1,m+1)}$, $R_{(n,m-1)}$, $R_{(n,m)}$, $R_{(n,m+1)}$, $R_{(n+1,m-1)}$, $R_{(n+1,m)}$, and $R_{(n+1,m+1)}$ represent the corresponding original gray scales of the red color subpixels of the nine-grid matrix.

For instance, the corresponding weights include $A_R=0$, $B_R=0.125$, $C_R=0$, $D_R=0.125$, $E_R=0.5$, $F_R=0.125$, $G_R=0$, $H_R=0.125$, and $I_R=0$, and the calibrated gray scale $R'_{(2,2)}$ for the red subpixels 351 and 353 are calculated below (refer to FIG. 21):

$R_{(2,2)}$(the original gray scale of the red color of the pixel 35)×0.5 ($E_R$)+$R_{(1,2)}$(the original gray scale of the red color of the left pixel 34)×0.125 ($D_R$)+ $R_{(3,2)}$(the original gray scale of the red color of the right pixel 36)×0.125 ($F_R$)+$R_{(2,1)}$(the original gray scale of the red color of the pixel 32)×0.125 ($B_R$)+$R_{(2,3)}$(the original gray scale of the red color of the pixel 38)×0.125 ($H_R$).

A similar adjustment is performed on the blue subpixels, in which the signals for two blue subpixels of every pixel are applied by the same data line 42.

A lookup table, such as a database, is provided for the blue color, in which the table includes a 3×3 matrix having nine weights $A_B$, $B_B$, $C_B$, $D_B$, $E_B$, $F_B$, $G_B$, $H_B$, and $I_B$. The sum of the nine weights is preferably 1 and the value for each weight can be set independently.

Figure 20:
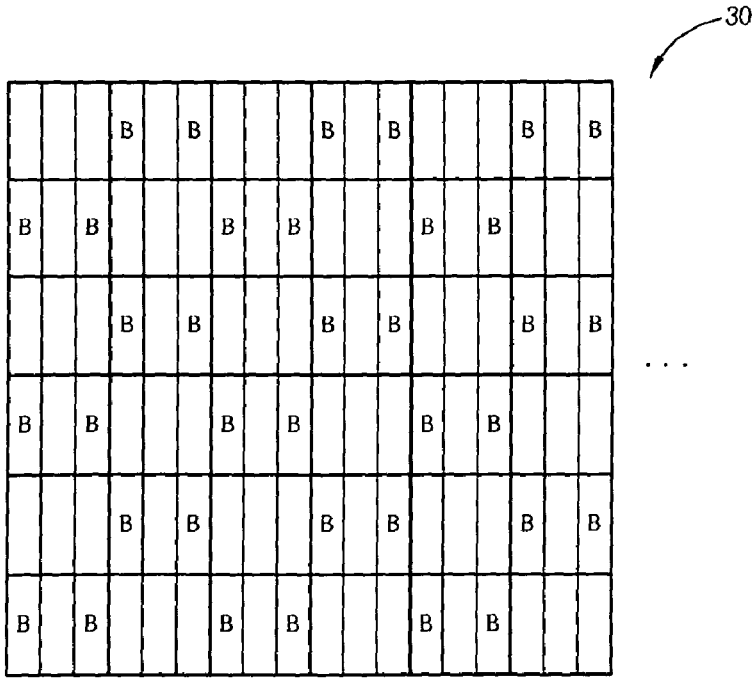

Next, all of the blue subpixels are combined into one group, as shown in FIG. 20, and the gray scale for each blue subpixel, referred to as $B'_{(n,m)}$, is calculated by a data processor and the result is stored in a memory. For example, the calculation is performed according to the following equation:

$$B'_{(n,m)} = \begin{bmatrix} B_{(n-1,m-1)} & B_{(n-1,m)} & B_{(n-1,m+1)} \\ B_{(n,m-1)} & B_{(n,m)} & B_{(n,m+1)} \\ B_{(n+1,m-1)} & B_{(n+1,m)} & B_{(n+1,m+1)} \end{bmatrix} * \begin{bmatrix} A_B & B_B & C_B \\ D_B & E_B & F_B \\ G_B & H_B & I_B \end{bmatrix} \quad \text{Equation (10)}$$

$$= A_B \times B_{(n-1,m-1)} + B_B \times B_{(n-1,m)} + C_B \times B_{(n-1,m+1)} + D_B \times B_{(n,m-1)} + E_B \times B_{(n,m)} + F_B \times B_{(n,m+1)} + G_B \times B_{(n+1,m-1)} + H_B \times B_{(n+1,m)} + I_B \times B_{(n+1,m+1)}$$

Preferably, B(n−1,m−1), $B_{(n-1,m)}$, $B_{(n-1,m+1)}$, $B_{(n,m-1)}$, $B_{(n,m)}$, $B_{(n,m+1)}$, $B_{(n+1,m-1)}$, $B_{(n+1,m)}$, and $B_{(n+1,m+1)}$ represent the corresponding original gray scales of the blue color subpixels of the nine-grid matrix.

For instance, the corresponding weights include $A_B$=0, $B_B$=0.125, $C_B$=0, $D_B$=0.125, $E_B$=0.5, $F_B$=0.125, $G_B$=0, $H_B$=0.125, and $I_B$=0, and the calibrated gray scale $B'_{(3,2)}$ for the blue subpixels 361 and 363 are calculated below (refer to FIG. 21):

$B_{(3,2)}$(the original gray scale of the red color of the pixel 36)×0.5 ($E_B$)+$B_{(2,2)}$(the original gray scale of the red color of the left pixel 35)×0.125 ($D_B$)+$B_{(4,2)}$(the original gray scale of the red color of the right pixel 304)×0.125 ($F_B$)+$B_{(3,1)}$(the original gray scale of the red color of the pixel 33)×0.125 ($B_B$)+$B_{(3,3)}$(the original gray scale of the red color of the pixel 39)×0.125 ($H_B$).

The gray scales corresponding to the green subpixels are not calibrated. Instead, the original gray scales of the green color are utilized as the calibrated gray scales.

Subsequently, a plurality of voltages corresponding to the calibrated gray scales of the red, green, and blue colors generated above are utilized to drive the corresponding subpixels within the frame and complete the display of the image.

By utilizing the displaying method of the disclosed embodiment of the present invention, the amount of data to be processed by the driver can be significantly decreased, e.g., approximately 33.33%.

Figure 21:
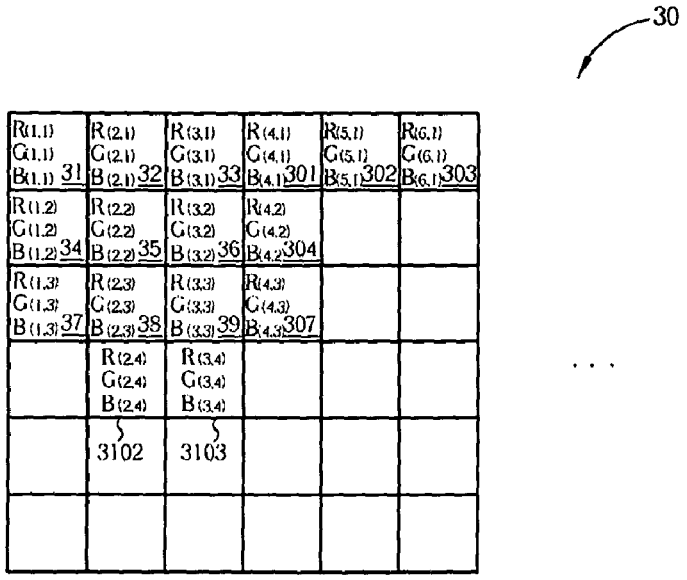
FIG. 21 is a diagram showing the corresponding gray scale of the red, green, and blue colors of image data.

IV. Another Embodiment According to the Displaying Method of the Present Invention Another embodiment utilizing the displaying method of the present invention is described below, using the staggered type liquid crystal display shown in FIG. 4. First, a plurality of image data is received within a frame, and the image data are divided into original gray scales corresponding to red, green, and blue as shown in FIG. 21. The original gray scales of the red color, green color, and blue color are represented by $R_{(n,m)}$, $G_{(n,m)}$, and $B_{(n,m)}$, respectively, where n and m are positive integers.

Next, each original gray scale is utilized, using the lookup table shown in FIG. 5, to generate a first gray scale and a second gray scale, respectively. For instance, $R_{(n,m)}$ is utilized to generate $R_{H(n,m)}$ and $R_{L(n,m)}$; $G_{(n,m)}$ is utilized to generate $G_{H(n,m)}$ and $G_{L(n,m)}$ and $B_{(n,m)}$ is utilized to generate $B_{H(n,m)}$ and $B_{L(n,m)}$.

Figure 22:
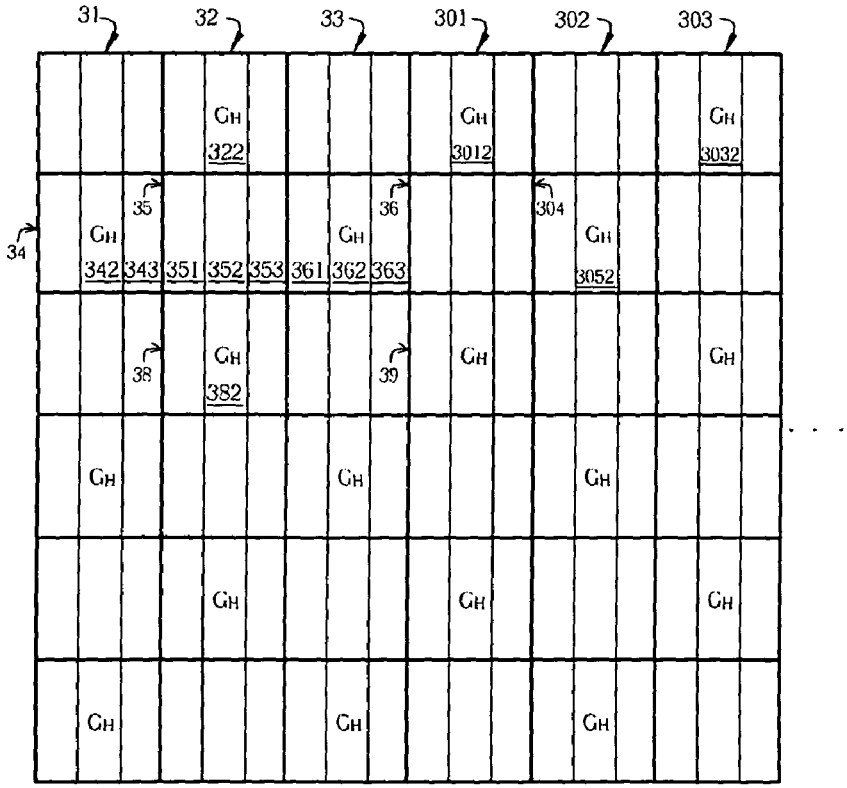
FIG. 22 and FIG. 23 are diagrams showing two green subpixel groups of the staggered type liquid crystal display.
Figure 23:
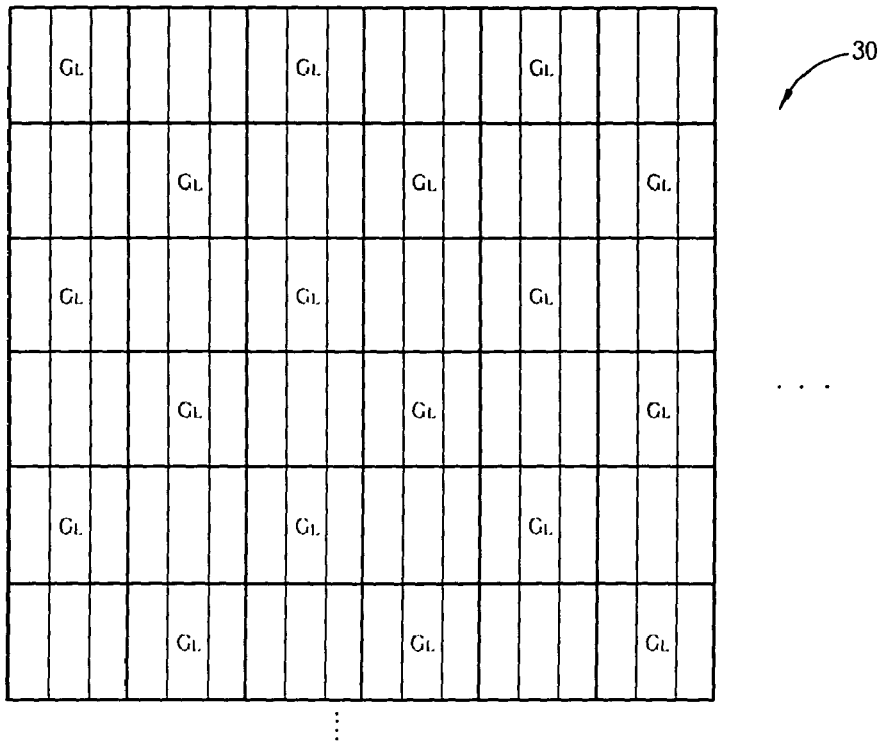

Next, the green subpixel group is divided into a first green subpixel group and a second green subpixel group, as shown in FIG. 22 and FIG. 23, respectively. The first green subpixel group displays the first gray scales, i.e., the higher gray scales. In the first green subpixel group, two of the adjacent green subpixels in each row are separated by five subpixels. For instance, the green subpixel 342 and the green subpixel 362 are separated by a blue subpixel 343, a red subpixel 351, a green subpixel 352, a red subpixel 353, and a blue subpixel 361. Additionally, the green subpixels of the two adjacent rows are staggered with respect to each other. For instance, the green subpixels 322, 3012, and 3032 in the first row are staggered with respect to the green subpixels 342, 362, and 3052 in the second row. Preferably, the green subpixels of the first green subpixel group are represented by GH.

The second green subpixel group is composed of the remaining green subpixels, and the second green subpixel group primarily displays the second gray scale, which is a lower gray scale. The arrangement of each green subpixel of the second subpixel group is similar to the arrangement of the green subpixels of the first subpixel group. In the second green subpixel group, two of the adjacent green subpixels in each row are separated by five subpixels. Additionally, the green subpixels of the two adjacent rows are staggered with respect to each other. Preferably, the green subpixels of the second green subpixel group are represented by $G_L$.

Figure 24:
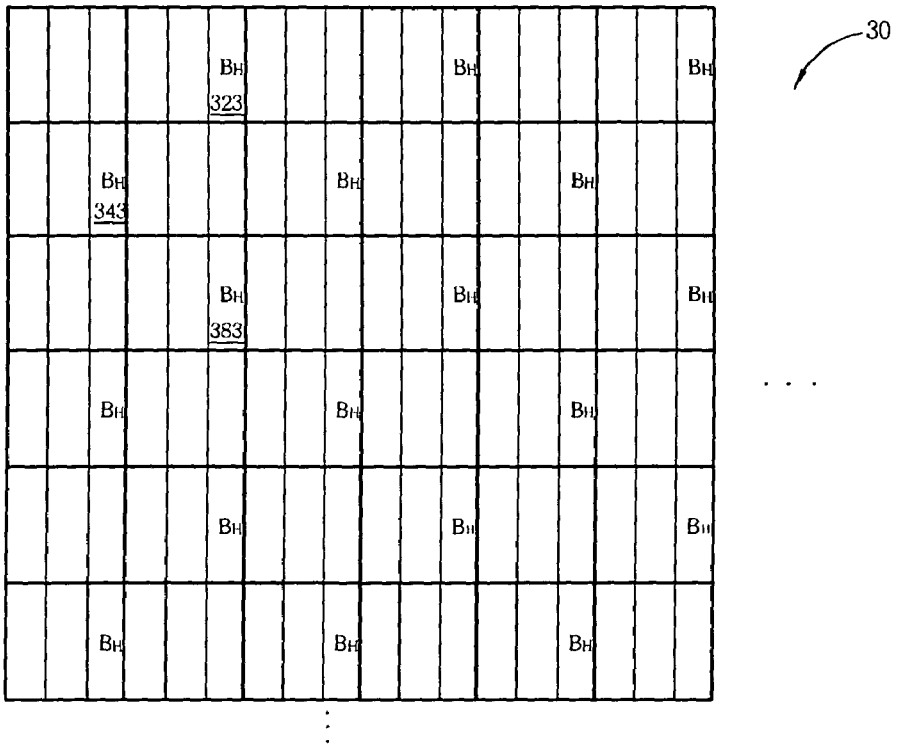
FIG. 24 and FIG. 25 are diagrams showing two blue subpixel groups of the staggered type liquid crystal display.
Figures 25, 26:
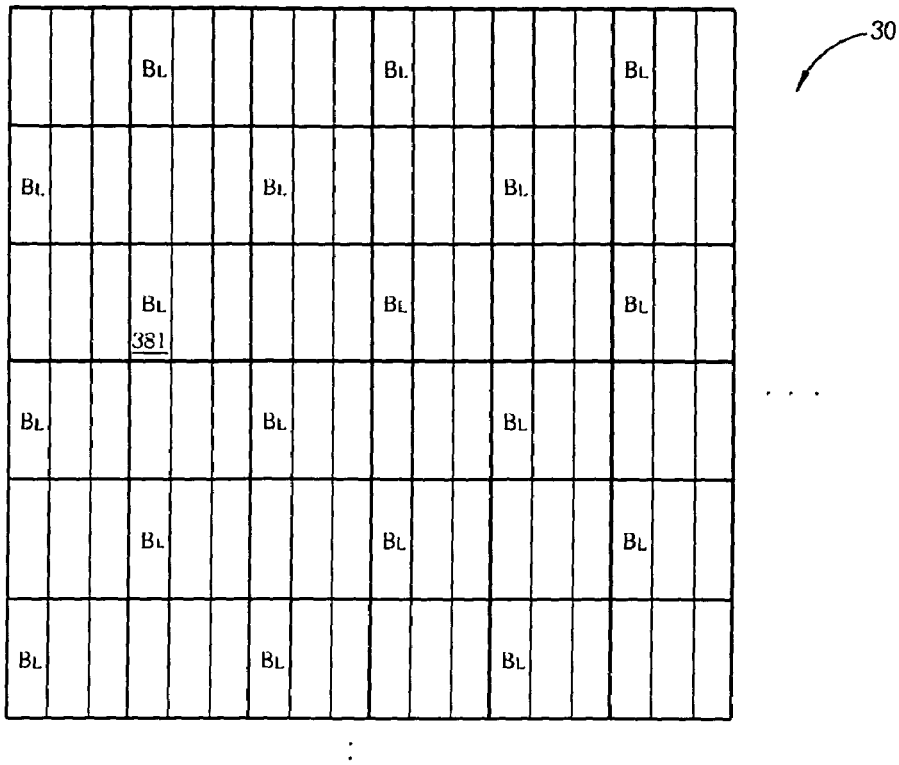
FIG. 26 is a diagram showing the calibrated gray scale of a plurality of subpixels of the staggered type liquid crystal display.

The blue subpixel group is divided into a first blue subpixel group and a second blue subpixel group, as shown in FIG. 24 and FIG. 25, respectively. The first blue subpixel group displays the first gray scales, i.e., the higher gray scales. In the first blue subpixel group, two of the adjacent blue subpixels in each row are separated by five subpixels, and the blue subpixels of the two adjacent rows are staggered with respect to each other. Preferably, the blue subpixels of the first blue subpixel group are represented by $B_H$. The second blue subpixel group is composed of the remaining blue subpixels, and the second blue subpixel group displays the second gray scales, i.e., the lower gray scales. The arrangement of the blue subpixels of the second blue subpixel group is similar to the arrangement of the blue subpixels from the first blue subpixel group. The blue subpixels of the second blue subpixel group are represented by $B_L$.

Next, the calibrated gray scale for each green or blue subpixel is set, whereas the gray scales for the red subpixels are not calibrated. Hence, the original gray scales of the red subpixels are utilized as their calibrated gray scales.

The setting of the gray scales for green subpixels and blue subpixels includes following steps:

First, a database, such as a lookup table, is provided as a filter table for the green color, in which the table includes a 3×3 matrix having nine weights $A_{GH}$, $B_{GH}$, $C_{GH}$, $D_{GH}$, $E_{GH}$, $F_{GH}$, $G_{GH}$, $H_{GH}$, and $I_{GH}$. The sum of the nine weights is preferably 1 and the value for each weight can be set independently. The calibrated gray scale $G'_{H(n,m)}$ for each green subpixel of the first group is calculated according to the Equation (3) described previously.

For instance, the corresponding weights include $A_{GH}$=0, $B_{GH}$=0.125, $C_{GH}$=0, $D_{GH}$=0.125, $E_{GH}$=0.5, $F_{GH}$=0.125, $G_{GH}$=0, $H_{GH}$=0.125, and $I_{GH}$=0, and the calibrated gray scale $G'_{H(3,2)}$ for the green subpixel 362 is calculated as follows:

$G_{H(3,2)}$(the first gray scale of the green subpixel pixel 362)×0.5 ($E_{GH}$)+$G_{H(2,2)}$(the first gray scale of the green color of the left subpixel 35)×0.125 ($D_{GH}$)+$G_{H(4,2)}$(the first gray scale of the green color of the right subpixel 304)×0.125($F_{GH}$)+$G_{H(3,1)}$(the first gray scale of the green color of the left subpixel 33)×0.125 ($B_{GH}$)+$G_{H(3,3)}$(the first gray scale of the green color of the left subpixel 39)×0.125 ($H_{GH}$)

The calibrated gray scale $G'_{H(n,m)}$ for each green subpixel of the first green subpixel group is therefore calculated, and the calibrated gray scale represents a bright state.

A database, such as a lookup table, is provided as a filter table for the second green subpixel group, in which the table includes a 3×3 matrix having nine weights $A_{GL}$, $B_{GL}$, $C_{GL}$, $D_{GL}$, $E_{GL}$, $F_{GL}$, $G_{GL}$, $H_{GL}$, and $I_{GL}$. The sum of the nine weights is preferably 1 and the value for each weight can be set independently. The calibrated gray scale $G'_{L(n,m)}$ for each green subpixel of the second group is calculated according to the Equation (4) described above.

The gray scales for the blue subpixels are also adjusted to generate the corresponding calibrated gray scales. A database, such as a lookup table, is provided as a filter table for the blue color, in which the table includes a 3×3 matrix having nine weights $A_{BH}$, $B_{BH}$, $C_{BH}$, $D_{BH}$, $E_{BH}$, $F_{BH}$, $G_{BH}$, $H_{BH}$, and $I_{BH}$ The sum of the nine weights is preferably 1 and the value for each weight can be set independently. The calibrated gray scale $B'_{H(n,m)}$ for each blue subpixel of the first group, representing a bright state display, is calculated according to the Equation (5) described above.

The gray scales for the second blue subpixel group are also adjusted to generate the corresponding calibrated gray scales. A database, such as a lookup table is provided as a filter table for the blue color, in which the table includes a 3×3 matrix having nine weights $A_{BL}$, $B_{BL}$, $C_{BL}$, $D_{BL}$, $E_{BL}$, $F_{BL}$, $G_{BL}$, $H_{BL}$, and $I_{BL}$. The sum of the nine weights is preferably 1 and the value for each weight can be set independently. The calibrated gray scale $B'_{L(n,m)}$ for each blue subpixel of the second group, representing a dark state display, is calculated according to the Equation (6) described above.

Hence, the calibrated gray scales for each blue subpixel of the first blue subpixel group and the second blue subpixel group can be calculated. For instance, the corresponding weights include $A_{BH}$=0, $B_{BH}$=0.125, $C_{BH}$=0, $D_{BH}$=0.125, $E_{BH}$=0.5, $F_{BH}$=0.125, $G_{BH}$=0, $H_{BH}$=0.125 and $I_{BH}$=0, and $A_{BL}$=0, $B_{BL}$=0.125, $C_{BL}$=0, $D_{BL}$=0.125, $E_{BL}$=0.5, $F_{BL}$=0.125, $G_{BL}$=0, $H_{BL}$=0.125 and $I_{BL}$=0, and the calibrated gray scales of the subpixels 352, 361, 362, 363, 381, 382, 383, and 392 from FIG. 22 through FIG. 25 are shown in FIG. 26. It should be noted that, in FIG. 26, the original grey scales of the red color, i.e., $R_{(2,2)}$, $R_{(3,3)}$, are used as calibrated grey scales of the red color of the corresponding pixel. Both subpixels, e.g., 351, 353, on the left- and right-sides of each pixel having red subpixels are controlled by the same voltage corresponding to the respective original/calibrated grey scale of the red color, e.g., $R_{(2,2)}$.

Figure 27:
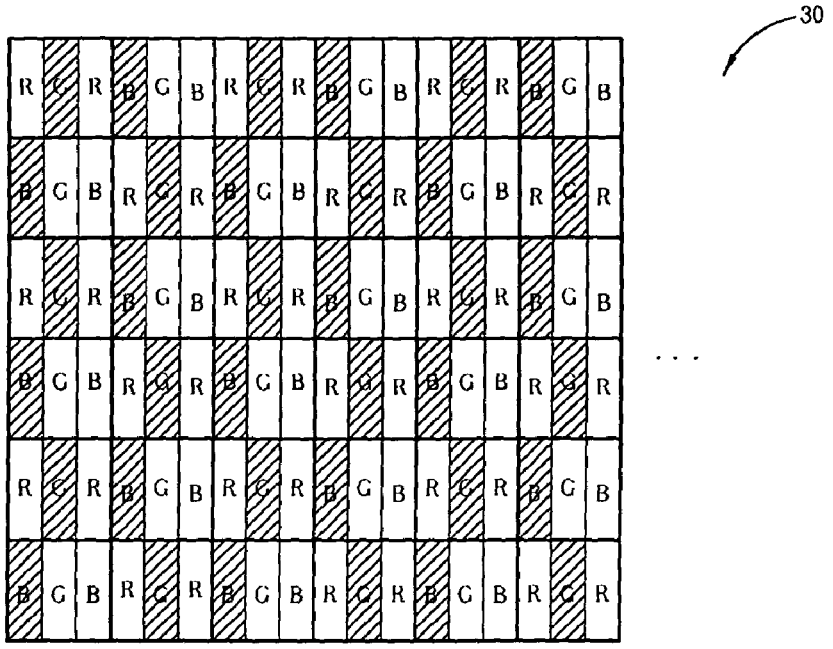
FIG. 27 is a diagram showing the displayed image of the staggered type liquid crystal display.

Finally, a plurality of voltages corresponding to the calibrated gray scales of each color generated above are utilized to drive the corresponding subpixels within the frame and complete the display of the image. FIG. 27 illustrates the displaying result after calibrating the gray scales and the distribution of the subpixels driven by dark state signals and bright state signals, in which the subpixels driven by dark state signals are cross-hatched. Preferably, the subpixels driven by the dark state signals are uniformly distributed within the image and not concentrated in a particular region, thereby significantly improving the uneven brightness problem shown in FIG. 2, and maintaining a lower color shift and a better viewing angle that are achieved by the driving of both bright state signals and dark state signals.

Since the red color generates the minimum amount of color shift from different viewing angles, the gray scales corresponding to the red subpixels in the above disclosed embodiment are not adjusted. Hence, the red color is directly displayed with the original gray scales and produces an image that is closer to the input data.

In an alternative embodiment, the gray scales of the red subpixels can also be adjusted to obtain the corresponding calibrated gray scales. Similarly, a database, such as a lookup table, is provided as a filter table for the first red subpixel group located on the left side of each pixel (e.g., subpixels 311, 331 in FIG. 4), in which the table includes a 3×3 matrix having nine weights $A_{R1}$, $B_{R1}$, $C_{R1}$, $D_{R1}$, $E_{R1}$, $F_{R1}$, $G_{R1}$, $H_{R1}$, and $I_{R1}$. The sum of the nine weights is preferably 1 and the value for each weight can be set independently. The calibrated gray scale $R'_{1(n,m)}$ for each red subpixel of the first red subpixel group is calculated according to the following equation:

$$R'_{1(n,m)} = \begin{bmatrix} R_{(n-1,m-1)} & R_{(n-1,m)} & R_{(n-1,m+1)} \\ R_{(n,m-1)} & R_{(n,m)} & R_{(n,m+1)} \\ R_{(n+1,m-1)} & R_{(n+1,m)} & R_{(n+1,m+1)} \end{bmatrix} * \begin{bmatrix} A_{R1} & B_{R1} & C_{R1} \\ D_{R1} & E_{R1} & F_{R1} \\ G_{R1} & H_{R1} & I_{R1} \end{bmatrix} = A_{R1} \times R_{(n-1,m-1)} + B_{R1} \times R_{(n-1,m)} + C_{R1} \times R_{(n-1,m+1)} + D_{R1} \times R_{(n,m-1)} + E_{R1} \times R_{(n,m)} + F_{R1} \times R_{(n,m+1)} + G_{R1} \times R_{(n+1,m-1)} + H_{R1} \times R_{(n+1,m)} + I_{R1} \times R_{(n+1,m+1)} \quad \text{Equation (11)}$$

Preferably, $R_{(n-1,m-1)}$, $R_{(n-1,m)}$, $R_{(n-1,m+1)}$, $R_{(n,m-1)}$, $R_{(n,m)}$, $R_{(n,m+1)}$, $R_{(n+1,m-1)}$, $R_{(n+1,m)}$, and $R_{(n+1,m+1)}$ represent the corresponding original gray scales of the red color subpixels of the nine-grid matrix.

A database, such as a lookup table, is provided as a filter table for the second red subpixel group located on the right side of each pixel (e.g., subpixels 313, 333 in FIG. 4), in which the table includes a 3×3 matrix having nine weights $A_{R2}$, $B_{R2}$, $C_{R2}$, $D_{R2}$, $E_{R2}$, $F_{R2}$, $G_{R2}$, $H_{R2}$, and $I_{R2}$. The sum of the nine weights is preferably 1 and the value for each weight can be set independently. The calibrated gray scale $R'_{2(n,m)}$ for each red subpixel of the second red subpixel group is calculated according to the following equation:

$$R'_{2(n,m)} = \begin{bmatrix} R_{(n-1,m-1)} & R_{(n-1,m)} & R_{(n-1,m+1)} \\ R_{(n,m-1)} & R_{(n,m)} & R_{(n,m+1)} \\ R_{(n+1,m-1)} & R_{(n+1,m)} & R_{(n+1,m+1)} \end{bmatrix} * \begin{bmatrix} A_{R2} & B_{R2} & C_{R2} \\ D_{R2} & E_{R2} & F_{R2} \\ G_{R2} & H_{R2} & I_{R2} \end{bmatrix} = A_{R2} \times R_{(n-1,m-1)} + B_{R2} \times R_{(n-1,m)} + C_{R2} \times R_{(n-1,m+1)} + D_{R2} \times R_{(n,m-1)} + E_{R2} \times R_{(n,m)} + F_{R2} \times R_{(n,m+1)} + G_{R2} \times R_{(n+1,m-1)} + H_{R2} \times R_{(n+1,m)} + I_{R2} \times R_{(n+1,m+1)} \quad \text{Equation (12)}$$

Preferably, R(n−1,m−1), $R_{(n-1,m)}$, $R_{(n-1,m+1)}$, $R_{(n,m-1)}$, $R_{(n,m)}$, $R_{(n,m+1)}$, $R_{(n+1,m-1)}$, $R_{(n+1,m)}$, and $R_{(n+1,m+1)}$ represent the corresponding original gray scales of the red color subpixels of the nine-grid matrix.

For instance, the filter table of the first red subpixel group shown in FIG. 28 includes values $A_{R1}$=0.0625, $B_{R1}$=0.0625, $C_{R1}$=0, $D_{R1}$=0.375, $E_{R1}$=0.375, $F_{R1}$=0, $G_{R1}$=0.0625, $H_{R1}$=0.0625, and $I_{R1}$=0, and the calibrated gray scales of the red subpixels of the first red subpixel group can be calculated. For example, the calibrated gray scale $R'_{1(2,2)}$ of the red subpixel 351 located on the left side of the top-left pixel in FIG. 26 is calculated as follows:

$$=R_{(2,2)}\times 0.375+R_{(1,2)}\times 0.375+R_{(2,1)}\times 0.0625+R_{(2,3)}\times 0.0625+R_{(1,1)}\times 0.0625+R_{(1,3)}\times 0.0625$$

Additionally, the filter table of the second red subpixel group shown in FIG. 28 includes values $A_{R2}=0$, $B_{R2}=0.0625$, $C_{R2}=0.0625$, $D_{R2}=0$, $E_{R2}=0.375$, $F_{R2}=0.375$, $G_{R2}=0$, $H_{R2}=0.0625$, and $I_{R2}=0.0625$, and the calibrated gray scales of the red subpixels of the second red subpixel group can be calculated. For example, the calibrated gray scale $R'_{2(2,2)}$ of the red subpixel 353 located on the right side of the top-left pixel in FIG. 26 is calculated as follows:

$$=R_{(2,2)}\times 0.375+R_{(3,2)}\times 0.375+R_{(2,1)}\times 0.0625+R_{(2,3)}\times 0.0625+R_{(3,1)}\times 0.0625+R_{(3,3)}\times 0.0625$$

The calibrated gray scales of the subpixels 351, 352, 353, 361, 362, 363, 381, 382, 383, and 392 from FIG. 22 through FIG. 25 are shown in FIG. 29.

Yet another embodiment of utilizing the displaying method of the embodiments of the present invention to calibrate the gray scales of the red subpixels is provided. This embodiment differs from the embodiments disclosed with respect to FIGS. 26 and 29 in the calibration of the red subpixels. In particular, a database, such as a lookup table, is provided as a filter table for the first red subpixel group, and the table includes a 3×3 matrix having nine weights $A_{RH}$, $B_{RH}$, $C_{RH}$, $D_{RH}$, $E_{RH}$, $F_{RH}$, $G_{RH}$, $H_{RH}$, and $I_{RH}$, and the value for each weight can be set independently. The calibrated gray scale $R'_{H(n,m)}$, representing a bright state display for each red subpixel of the first group is calculated according to the Equation (7) discussed above.

Another database, such as a lookup table, is provided as a filter table for the second red subpixel group, and the table includes a 3×3 matrix having nine weights $A_{RL}$, $B_{RL}$, $C_{RL}$, $D_{RL}$, $E_{RL}$, $F_{RL}$, $G_{RL}$, $H_{RL}$, and $I_{RL}$. The sum of the nine weights is preferably 1 and the value for each weight can be set independently. The calibrated gray scale $R'_{L(n,m)}$, representing a dark state display for each red subpixel of the second group is calculated according to the Equation (8) discussed above.

For instance, the corresponding weights include $A_{RH}=0$, $B_{RH}=0.125$, $C_{RH}=0$, $D_{RH}=0.125$, $E_{RH}=0.5$, $F_{RH}=0.125$, $G_{RH}=0$, $H_{RH}=0.125$, $I_{RH}=0$, and $A_{RL}=0$, $B_{RL}=0.125$, $C_{RL}=0$, $D_{RL}=0.125$, $E_{RL}=0.5$, $F_{RL}=0.125$, $G_{RL}=0$, $H_{RL}=0.125$, and $I_{RL}=0$.

Finally, a plurality of voltages corresponding to the calibrated gray scales of the red, green, and blue colors generated above are utilized to drive the corresponding subpixels within the frame and complete the display of the image. Preferably, the subpixels driven by the dark state signals are uniformly distributed within the image and not concentrated in a particular region, thereby significantly improving the color shift and viewing angle from the previously disclosed embodiment that only calibrates the gray scales of the green subpixels and the blue subpixels. Additionally, the present embodiment also maintains the advantage of utilizing both the bright state signals and the dark state signals to drive the subpixels, thereby providing a lower color shift and a better viewing angle.

V. Another Embodiment According to the Displaying Method of the Present Invention Preferably, both the stripe type and the staggered type liquid crystal displays are configured to be operable in both a low color shift (LCS) mode and a text mode.

In the LCS mode, each original gray scale is utilized to generate a higher gray scale (corresponding to a bright state) and a lower gray scale (corresponding to a dark state) for improving the color shift phenomenon. Examples of displaying methods using the LCS mode include the embodiments disclosed above with respect to equations (1)-(8).

In the text mode, the display device is driven directly by the original gray scales. In particular, the stripe type liquid crystal display is configured to be operable in the text mode by utilizing the traditional driving method.

When the staggered type liquid crystal display operates in the text mode, the subpixels located in at least one of the marginal colurns of the display are not utilized, in accordance with an embodiment, to create an effect of a pixel shift, and form a plurality of new displaying pixels. For example, as shown in FIG. 30, the first (leftmost) column of subpixels is not utilized, hence the subsequent, adjacent green, red, and blue subpixels will form a new pixel, indicated as ① and ② in FIG. 30.

It should be noted that the embodiment disclosed with respect to equations (3)-(6) is considered to operate in the LCS mode even though the red subpixels are driven using the original red-color gray scales. The reason is that the color shift phenomenon is still improved through driving the green and blue subpixels using the generated higher and lower gray scales.

Likewise, the embodiment disclosed with respect to equations (11) and (12) is considered to operate in the LCS mode even though not all subpixels are driven in the LCS mode. In particular, because only half of the pixels have red-color subpixels, the display device of this embodiment cannot be driven using the red-color original gray scales directly. Instead, the original red-color gray scales are adjusted to corresponding calibrated red-color gray scales utilizing equations (11) and (12). The color shift phenomenon is still improved through driving the green and blue subpixels using the generated higher and lower gray scales.

It should be also noted that the embodiment disclosed with respect to equations (9) and (10) involves a specific subpixel arrangement for saving cost by decreasing the amount of data to be processed, and hence, the number of data drivers needed. Although this embodiment does not use the original gray scales directly (as the original gray scales are adjusted to corresponding calibrated gray scales), neither does it have the effect of the LCS mode. In addition, it is uneasy to switch this embodiment to the LCS mode due to the reduced number of data drivers. Therefore, this embodiment is considered closer to the text mode than to the LCS mode.

It should be further noted that, in most cases, the utilization of low pass filters for achieving pixel sharing in the LCS mode will produce images having un-sharp edges. If a dynamic picture or movie is displayed, such un-sharp edges will be unnoticeable to the average human eye, and therefore acceptable. However, if a static picture or text is displayed, un-sharp edges will become noticeable to the average human eye, and therefore unacceptable. Therefore, it is within the scope of the present invention to use the LCS mode for dynamic pictures, i.e., for watching movie or TV, and to use the text mode for static pictures, e.g., for word processing software. Hence, by utilizing the displaying method in accordance with the embodiments of the present invention, it is possible and desirable to switch from one mode to another to obtain the best displaying result. A converter (not shown) can be utilized to actively and, preferably, automatically, switch the displaying mode between the LCS mode and the text mode.

The displaying method in accordance with the disclosed embodiments for driving liquid crystal displays can also be achieved by utilizing a high pass filter to analyze the spatial frequency of images and distinguish the high frequency region from the low frequency region of an image. The high frequency region of the image refers to the edge portion of the image, in which the displaying method in this particular region primarily involves the utilization of the text mode to achieve better image sharpness. The low frequency region of the image, on the other hand, utilizes the LCS mode for displaying the image, thereby producing an optimal viewing angle and color shift. The combination of the text mode and the LCS mode can be optimized by utilizing the following method in accordance with an embodiment.

First, a plurality of image data is received within a frame, in which each image data is utilized to control a corresponding pixel within the frame to display a corresponding, original gray scale for each color.

Next, a high pass (filter) lookup table, such as a database, is provided, in which the table includes a 3×3 matrix having nine weights $A_f$, $B_f$, $C_f$, $D_f$, $E_f$, $F_f$, $G_f$, $H_f$, and $I_f$ in a manner similar to FIG. 6. For instance, the values of the weight may include the following: $A_f=-1$, $B_f=-1$, $C_f=-1$, $D_f=-1$, $E_f=-8$, $F_f=-1$, $G_f=-1$, $H_f=-1$, and $I_f=-1$.

The high pass lookup table is utilized to calculate the corresponding spatial frequency of each subpixel. The spatial frequency F of each subpixel can be obtained by calculating the convolution using the original gray scales and the high pass lookup table according to the following equation:

$$F = \left\| \begin{bmatrix} g1 & g2 & g3 \\ g4 & g5 & g6 \\ g7 & g8 & g9 \end{bmatrix} * \begin{bmatrix} A_f & B_f & C_f \\ D_f & E_f & F_f \\ G_f & H_f & I_f \end{bmatrix} \right\| \quad \text{Equation (13)}$$

Preferably, g1, g2, g3, g4, g5, g6, g7, g8, and g9 represent the original gray scales of the same color subpixels within the nine adjacent pixels, in which g5 represents the original gray scale of the same color subpixel of the center pixel, whereas the remaining values represent the original gray scales of the same color subpixels located at the top left, top, top right, left, right, bottom left, bottom, and bottom right of the center pixel. F is the absolute value calculated from the matrix above. If F is greater than a threshold T, F is set as the threshold T. The value of the threshold T can be adjusted, e.g., by the user, and the threshold T may be set at, e.g., 512.

Preferably, a distributed weight is determined as (W)=F/T. Since F is between 0 and T, which includes 0 and T, W is therefore distributed between 0 and 1, which also includes 0 and 1.

Assume that a particular subpixel has an output gray scale A in the LCS mode and an output gray scale B in the text mode according to the displaying method of embodiments of the present invention, an output gray scale (OUTPUT) can be calculated using the weight distribution according to the following equation:

$$\text{OUTPUT}=A\times(1-W)+B\times W$$

Finally, a plurality of voltages corresponding to the output gray scales OUTPUT are utilized to drive the corresponding subpixels within the frame for displaying the image. By utilizing the displaying method of the embodiments of the present invention, the text mode will be utilized more heavily at the edge regions of the image, thereby displaying the image with sharper and clearer edges.

The output gray scales B in the text mode can be further adjusted. In other words, the original gray scale of a subpixel in the text mode can be calibrated, e.g., by utilizing the original gray scales of the subpixels of the pixel having that subpixel and the surrounding pixels and a gray scale lookup table. The gray scale lookup table includes a plurality of weights corresponding to the pixel having that subpixel and the surrounding pixels. Hence, the output gray scale of the subpixel is generated according to the weight distribution W between the calibrated gray scale and the original calibrated gray scale of the subpixel.

When the displaying method of the embodiments of the present invention is used in a 60 dpi staggered type liquid crystal display, the distance of just noticeable difference (J.N.D) in the LCS mode is approximately 100 cm, and the distance of just noticeable difference in the text mode is approximately 50 cm. Preferably, a much better displaying result can be achieved by switching between the LCS mode and the text mode or by combining these two modes. Additionally, the pixel arrangement of the staggered type liquid crystal display according to the embodiments of the present invention will produce an optimal skin tone in the LCS mode.

Preferably, the displaying method of the embodiments of the present invention utilizes a 2×3 electrical inverting form and a horizontal feedback to drive the subpixels, as shown in FIG. 31, thereby preventing problems such as line flickering or horizontal crosstalk.

Figure 32:
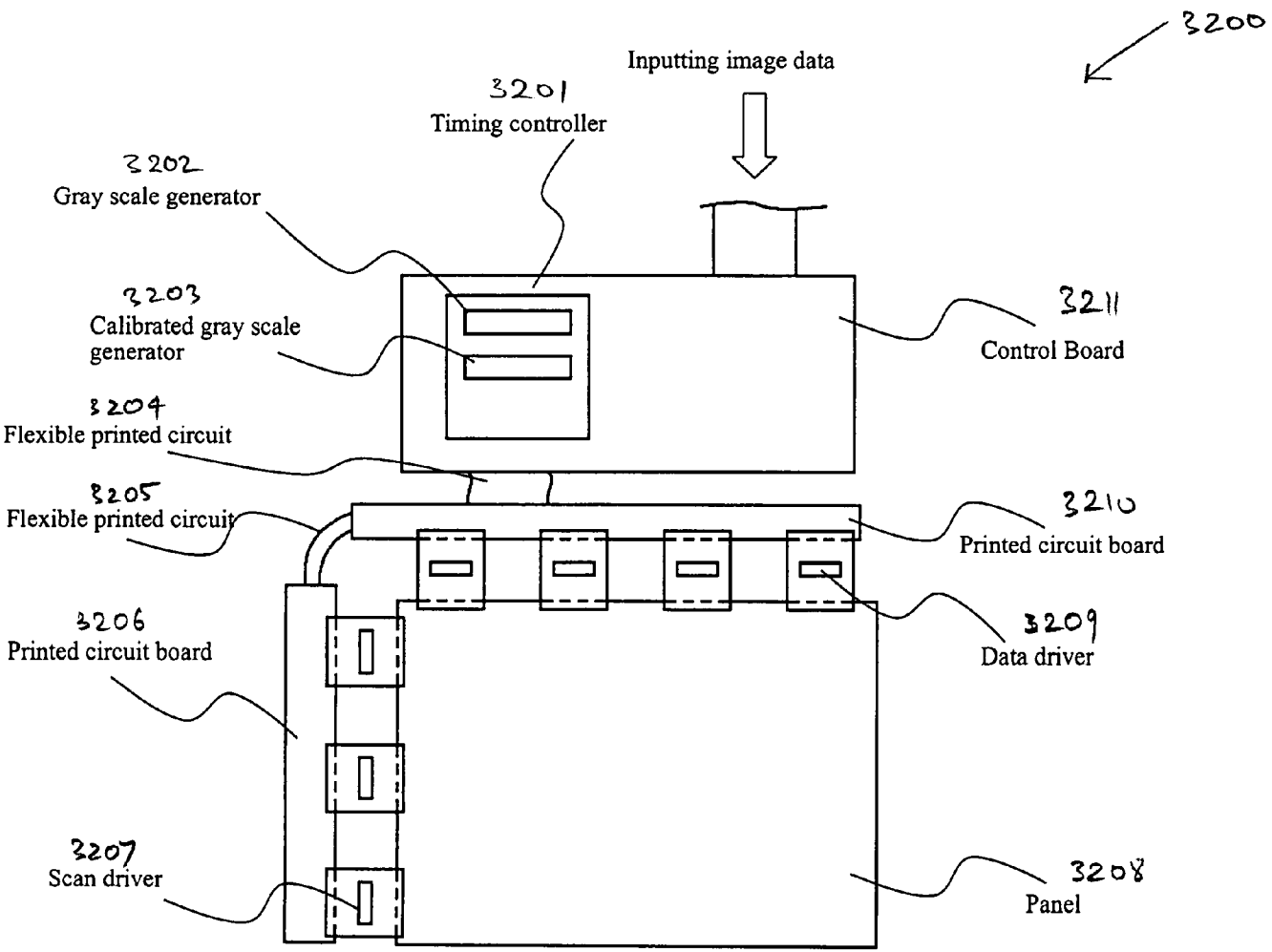
FIG. 32 is a diagram showing a display device in accordance with an embodiment of the present invention.

FIG. 32 is a diagram showing a display device 3200 in accordance with an embodiment of the present invention. Display device 3200 includes a timing controller 3201, a gray scale generator 3202, a calibrated gray scale generator 3203, flexible printed circuits (FPC) 3204 and 3205, printed circuit boards (PCB) 3206 and 3210, scan drivers 3207, a panel, e.g., an LCD panel, 3208, data drivers 3209, and control board 3211. In operation, the image data are input into the timing controller 3201 via the control board 3211. The gray scale generator 3202 and calibrated gray scale generator 3203 are integrally formed in the timing controller 3201. The outputs (i.e., original/calibrated/output grey scales) of the gray scale generator 3202 and/or calibrated gray scale generator 3203 are sent by the timing controller 3201 to data drivers 3209 and scan drivers 3207 via the flexible printed circuits 3204, 3205 and printed circuit boards 3210, 3206. Afterwards, data drivers 3209 and scan drivers 3207 drive the panel 3208 to display the image. The gray scale generator 3202 and calibrated gray scale generator 3203 can be incorporated into a single component and/or can be realized by software only, by hardware only, or by both hardware and software.

Those skilled in the art will readily observe that numerous modifications and alterations of the device and method may be made while retaining the teachings of the invention. Accordingly, the above disclosure should not be construed as limiting the metes and bounds of the present invention, which are defined by the appended claims.

What is claimed is:

1. A displaying method for use in an image display, wherein the image display comprises a plurality of pixels arranged in a matrix, each of the pixels comprises at least one subpixel of a primary color, the displaying method comprising:

receiving a plurality of image data, wherein each of the image data controls a corresponding pixel to display a color which corresponds to an original gray scale of said primary color;

generating a first gray scale and a second gray scale from each said original gray scale;

dividing subpixels of the same primary color into a first subpixel group and a second subpixel group, wherein the first subpixel group and the second subpixel group are separated in a chessboard form;

for each pixel having the subpixel belonging to the first group, utilizing the first gray scales of said pixel and the surrounding pixels to generate a first calibrated gray scale for said pixel;

for each pixel having the subpixel belonging to the second group, utilizing the second gray scale of said pixel and the surrounding pixels to generate a second calibrated gray scale of said pixel;

for each pixel, calculating a spatial frequency F based on the original grey scales of said pixel and the surrounding pixels;

generating a distributed weight W according to a threshold T and the spatial frequency F;

utilizing the first or the second calibrated gray scale and the original gray scale of the subpixel of said pixel to obtain an output gray scale of said pixel according to the distributed weight W; and utilizing a plurality of voltages corresponding to the output gray scales to drive the corresponding subpixels;

wherein nine weights ($A_f$, $B_f$, $C_f$, $D_f$, $E_f$, $F_f$, $G_f$, $H_f$ and $I_f$) corresponding to each pixel and the surrounding pixels are used to generate the spatial frequency F of said pixel according to the following relation:

$$F = \left\| \begin{bmatrix} g1 & g2 & g3 \\ g4 & g5 & g6 \\ g7 & g8 & g9 \end{bmatrix} * \begin{bmatrix} A_f & B_f & C_f \\ D_f & E_f & F_f \\ G_f & H_f & I_f \end{bmatrix} \right\|$$

where g5, g1, g2, g3, g4, g6, g7, g8, and g9 are the original gray scales of said pixel and the surrounding pixels, respectively.

2. A displaying method for use in an image display, wherein the image display comprises a plurality of pixels arranged in a matrix, each of the pixels comprises at least one subpixel of a primary color, the displaying method comprising:

receiving a plurality of image data, wherein each of the image data controls a corresponding pixel to display a color which corresponds to an original gray scale of said primary color;

generating a first gray scale and a second gray scale from each said original gray scale;

dividing subpixels of the same primary color into a first subpixel group and a second subpixel group, wherein the first subpixel group and the second subpixel group are separated in a chessboard form;

for each pixel having the subpixel belonging to the first group, utilizing the first gray scales of said pixel and the surrounding pixels to generate a first calibrated gray scale for said pixel;

for each pixel having the subpixel belonging to the second group, utilizing the second gray scale of said pixel and the surrounding pixels to generate a second calibrated gray scale of said pixel;

for each pixel, calculating a spatial frequency F based on the original grey scales of said pixel and the surrounding pixels;

generating a distributed weight W according to a threshold T and the spatial frequency F;

utilizing the first or the second calibrated gray scale and the original gray scale of the subpixel of said pixel to obtain an output gray scale of said pixel according to the distributed weight W; and utilizing a plurality of voltages corresponding to the output gray scales to drive the corresponding subpixels;

wherein the distributed weight W and the output gray scale of each pixel are determined using the following relations:

distributed weight W=spatial frequency F/threshold T; and output gray scale=first or second calibrated gray scale*(1−W)+original gray scale*W.

* * * * *